US012781144B2

(12) United States Patent
Weiss et al.

(10) Patent No.: US 12,781,144 B2
(45) Date of Patent: Nov. 3, 2026

(54) PROCESS FOR THE TREATMENT OF PLASTICS PYROLYSIS OILS INCLUDING A HYDROGENATION STAGE AND A HOT SEPARATION

(71) Applicants: IFP ENERGIES NOUVELLES, Rueil-Malmaison (FR); REPSOL S.A., Madrid (ES)

(72) Inventors: Wilfried Weiss, Rueil-Malmaison (FR); Dominique Decottignies, Rueil-Malmaison (FR); Jérôme Bonnardot, Rueil-Malmaison (FR); Iñigo Ribas Sangüesa, Madrid (ES); Martin Santos Martinez, Madrid (ES); Sheyla Carrasco Hernandez, Madrid (ES)

(73) Assignees: IFP ENERGIES NOUVELLES, Rueil-Malmaison (FR); REPSOL S.A., Madrid (ES)

( * ) Notice: Subject to any disclaimer, the term of this patent is extended or adjusted under 35 U.S.C. 154(b) by 200 days.

(21) Appl. No.: 18/715,341

(22) PCT Filed: Nov. 23, 2022

(86) PCT No.: PCT/EP2022/082956
§ 371 (c)(1),
(2) Date: May 31, 2024

(87) PCT Pub. No.: WO2023/099304
PCT Pub. Date: Jun. 8, 2023

(65) Prior Publication Data

US 2025/0034465 A1 Jan. 30, 2025

(30) Foreign Application Priority Data

Dec. 3, 2021 (FR) ..... 2112908

(51) Int. Cl.
*C10G 65/12* (2006.01)
*C10G 47/12* (2006.01)

(52) U.S. Cl.
CPC ..... *C10G 65/12* (2013.01); *C10G 47/12* (2013.01); *C10G 2300/1003* (2013.01); *C10G 2300/205* (2013.01)

(58) Field of Classification Search
CPC ..... C10G 25/00; C10G 45/38; C10G 47/02; C10G 65/12; C10G 69/06; C10G 45/44;
(Continued)

(56) References Cited

U.S. PATENT DOCUMENTS 3,678,905 A 7/1972 Diehl
4,498,972 A 2/1985 Toulhoat et al.
(Continued)

FOREIGN PATENT DOCUMENTS

WO WO-2014001632 A1 * 1/2014 ..... C10G 65/04
WO 2021110395 A1 6/2021
WO 2021165178 A1 8/2021

OTHER PUBLICATIONS

International Search Report PCT/EP2022/082956 dated Jan. 16, 2023 (pp. 1-2).

*Primary Examiner* — Vishal V Vasisth
(74) *Attorney, Agent, or Firm* — Millen, White, Zelano & Branigan, PC; Brion P. Heaney

(57) ABSTRACT

The present invention relates to a process for the treatment of a plastics pyrolysis oil, comprising:

a) the hydrogenation of said feedstock as a mixture with at least a part of the liquid effluent resulting from stage c) and in the presence of hydrogen and of a catalyst at a temperature between 14° and 340° C.;

b) the hydrotreating of said hydrogenated effluent in the presence of hydrogen and of a catalyst;

(Continued)

c) a separation of the hydrotreated effluent operated at high temperature and high pressure, in order to obtain a gaseous effluent and a liquid effluent, a part of which is recycled upstream of stage a), d) a separation operated at low temperature and high pressure and fed with the gaseous effluent and the other part of the liquid effluent resulting from stage c) and an aqueous solution, in order to obtain a hydrocarbon effluent.

19 Claims, 1 Drawing Sheet

(58) Field of Classification Search
CPC ..... C10G 21/20; C10G 47/12; C10G 65/06; C10G 9/36; C10G 31/09; C10G 1/10; C10G 5/04; C10G 1/002; C10G 49/22; C10G 45/08; C10G 2300/205; C10G 2300/1003
See application file for complete search history.

(56) References Cited

U.S. PATENT DOCUMENTS

| | | | | |
|---|---|---|---|---|
| 4,510,042 | A | 4/1985 | Billon et al. | |
| 4,818,743 | A | 4/1989 | Simpson et al. | |
| 5,007,998 | A * | 4/1991 | Gruia ..... | C10G 65/12 208/100 |
| 5,089,463 | A | 2/1992 | Johnson | |
| 5,221,656 | A | 6/1993 | Clark et al. | |
| 5,622,616 | A | 4/1997 | Porter et al. | |
| 5,827,421 | A | 10/1998 | Sherwood, Jr. | |
| 6,332,976 | B1 | 12/2001 | Mignard et al. | |
| 6,589,908 | B1 | 7/2003 | Ginestra et al. | |
| 7,119,045 | B2 | 10/2006 | Magna et al. | |
| 10,513,661 | B2 | 12/2019 | Narayanaswamy et al. | |
| 10,843,158 | B2 | 11/2020 | Plais et al. | |
| 2007/0080099 | A1 | 4/2007 | Reid et al. | |
| 2019/0161683 | A1 * | 5/2019 | Narayanaswamy ... | C10G 69/14 |
| 2023/0002688 | A1 | 1/2023 | Weiss et al. | |
| 2023/0029587 | A1 | 2/2023 | Weiss et al. | |

* cited by examiner

PROCESS FOR THE TREATMENT OF PLASTICS PYROLYSIS OILS INCLUDING A HYDROGENATION STAGE AND A HOT SEPARATION

This application is a 371 of PCT/EP2022/082956, filed Nov. 23, 2022.

TECHNICAL FIELD

The present invention relates to a process for the treatment of a plastics pyrolysis oil in order to obtain a hydrocarbon effluent which can be upgraded in a unit for the storage of petrol, jet or gas oil fuels or as feedstock for a steam cracking unit. More particularly, the present invention relates to a process for the treatment of a feedstock resulting from the pyrolysis of plastic waste in order to at least partially remove impurities which said feedstock may contain in relatively high amounts.

PRIOR ART

The plastics resulting from collection and sorting channels can undergo a stage of pyrolysis in order to obtain, inter alia, pyrolysis oils. These plastics pyrolysis oils are generally incinerated in order to generate electricity and/or used as fuel in industrial or urban heating boilers.

Another route for upgrading plastics pyrolysis oils is the use of these plastics pyrolysis oils as feedstock for a steam cracking unit in order to (re)create olefins, the latter being constituent monomers of certain polymers. However, plastic waste is generally a mixture of several polymers, for example mixtures of polyethylene, polypropylene, polyethylene terephthalate, polyvinyl chloride or polystyrene. Furthermore, depending on the uses, the plastics may contain, in addition to the polymers, other compounds, such as plasticizers, pigments, dyes or also polymerization catalyst residues. Plastic waste may additionally contain, in a minor amount, biomass originating, for example, from household waste. The treatment of the waste, on the one hand, in particular the storage, the mechanical treatments, the sorting, the pyrolysis, and also the storage and the transportation of pyrolysis oil, on the other hand, can also cause corrosion. As a consequence thereof, the oils resulting from the pyrolysis of plastic waste comprise many impurities, in particular diolefins, metals, especially iron, silicon, or also halogenated compounds, in particular chlorine-based compounds, heteroelements, such as sulfur, oxygen and nitrogen, and insoluble materials, at contents which are often high and incompatible with steam cracking units or units located downstream of the steam cracking units, in particular polymerization processes and selective hydrogenation processes. These impurities can give rise to operability problems and in particular problems of corrosion, of coking or of catalytic deactivation, or also incompatibility problems in the uses of the target polymers. The presence of diolefins can also result in problems of instability of the pyrolysis oil, characterized by the formation of gums. The gums and the insoluble materials which may be present in the pyrolysis oil can give rise to problems of clogging in the processes.

Furthermore, during the steam cracking stage, the yields of light olefins desired for the petrochemical industry, in particular ethylene and propylene, are strongly dependent on the quality of the feedstocks sent to steam cracking. The BMCI (Bureau of Mines Correlation Index) is often used to characterize hydrocarbon cuts. This index, developed for hydrocarbon products resulting from crude oils, is calculated from the measurement of the density and of the average boiling point: it is equal to 0 for a linear paraffin and to 100 for benzene. Its value thus increases in proportion as the product analysed has a condensed aromatic structure, naphthenes having an intermediate BMCI between paraffins and aromatics. Overall, the yields of light olefins increase when the paraffin content increases and thus when the BMCI decreases. Conversely, the yields of undesired heavy compounds and/or of coke increase when the BMCI increases.

The document WO 2018/055555 proposes an overall process for the recycling of plastic waste which is very general and relatively complex, ranging from the very stage of pyrolysis of the plastic waste up to the steam cracking stage. The process of application WO 2018/055555 comprises, inter alia, a stage of hydrotreating the liquid phase resulting directly from the pyrolysis, preferably under quite stringent conditions, in particular in terms of temperature, for example at a temperature of between 26° and 300° C., a stage of separation of the hydrotreating effluent and then a stage of hydrodealkylation of the separated heavy effluent at a preferably high temperature, for example of between 26° and 400° C.

The unpublished patent application FR 21/00.026 describes a process for the treatment of a plastics pyrolysis oil, comprising:

a) the hydrogenation of said feedstock in the presence at least of hydrogen and of at least one hydrogenation catalyst at an average temperature between 14° and 340° C., the outlet temperature of stage a) being at least greater by 15° C. than the inlet temperature of stage a), in order to obtain a hydrogenated effluent;

b) the hydrotreating of said hydrogenated effluent in the presence at least of hydrogen and of at least one hydrotreating catalyst, in order to obtain a hydrotreated effluent, the average temperature of stage b) being greater than the average temperature of stage a);

c) a separation of the hydrotreated effluent in the presence of an aqueous stream, at a temperature between 5° and 370° C., in order to obtain at least one gaseous effluent, an aqueous liquid effluent and a hydrocarbon liquid effluent.

In this application FR 21/00.026, the hydrogenation of the diolefins and a part of the hydrotreating reactions, in particular a part of the hydrogenation of the olefins and of the hydrodemetallization reactions, in particular the retention of silicon, are carried out in one and the same stage (stage a)) and at a temperature sufficient to limit the deactivation of the catalyst. This same stage also makes it possible to benefit from the heat from hydrogenation reactions, in particular reactions for hydrogenation of a part of the diolefins, so as to have an increasing temperature profile in this stage and thus to be able to eliminate the need for a heating device between the catalytic hydrogenation section and the catalytic hydrotreating section.

The control of the temperature is important in stage a) and must satisfy an antagonistic constraint. On the one hand, the inlet temperature and the temperature throughout the hydrogenation reaction section must be sufficiently low in order to make possible the hydrogenation of the diolefins and olefins at the beginning of the hydrogenation reaction section. On the other hand, the inlet temperature of the hydrogenation reaction section must be sufficiently high in order to prevent deactivation of the catalyst. As the hydrogenation reactions, in particular the hydrogenation of a part of the olefins and diolefins, are highly exothermic, an increasing profile of the temperature is then observed in the hydrogenation reaction section. This higher temperature at the end of said section makes it possible to carry out the hydrodemetallization and hydrodechlorination reactions.

Thus, due to the highly exothermic nature of all of the reactions carried out in this stage a), control of the temperature of the reaction medium proves to be very important because an excessively high level of the temperatures promotes:

- self-sustainment, indeed even runaway, of the reactions by an effect of thermal acceleration of the kinetics,
- undesirable side reactions, such as, for example, polymerization, coking of the catalysts or also cracking reactions.

It is known that the recycling of a part of the product obtained towards or upstream of at least one of the reaction stages advantageously makes it possible, on the one hand, to dilute the impurities and, on the other hand, to control the temperature in the reaction stage(s), in which the reactions involved can be highly exothermic. The application FR 21/00.026 thus describes the possibility of recycling a part of the product obtained after stage c) of separation and of washing with water (recycle under cold conditions).

The present invention provides an improvement to this principle of control of the exothermicity by recycling by providing a process scheme for the treatment of a feedstock comprising a plastics pyrolysis oil, making possible, by the use of a recycle of hot liquid at the inlet of the hydrogenation stage a), precise control of the temperatures, improved management of the exothermicity and of the different reactions taking place in the different catalytic zones.

SUMMARY OF THE INVENTION

More specifically, the invention relates to a process for the treatment of a feedstock comprising a plastics pyrolysis oil, comprising:

a) a hydrogenation stage carried out in a hydrogenation reaction section, employing at least one fixed-bed reactor having n catalytic beds, n being an integer greater than or equal to 1, each comprising at least one hydrogenation catalyst, said hydrogenation reaction section being fed at least with said feedstock as a mixture with at least a part of a liquid effluent resulting from a separation stage c) and a first gas stream comprising hydrogen, said hydrogenation reaction section being employed at an average temperature between 14° and 400° C., a partial hydrogen pressure between 1.0 and 10.0 MPa abs. and an hourly space velocity between 0.1 and 10.0 $h^1$, in order to obtain a hydrogenated effluent, b) a hydrotreating stage carried out in a hydrotreating reaction section, employing at least one fixed-bed reactor having n catalytic beds, n being an integer greater than or equal to 1, each comprising at least one hydrotreating catalyst, said hydrotreating reaction section being fed at least with said hydrogenated effluent resulting from stage a) and a second gas stream comprising hydrogen, said hydrotreating reaction section being employed at an average temperature between 25° and 430° C., a partial hydrogen pressure between 1.0 and 10.0 MPa abs. and an hourly space velocity between 0.1 and 10.0 $h^{-1}$, in order to obtain a hydrotreated effluent, c) a separation stage, fed with the hydrotreated effluent resulting from stage b), said stage being carried out at a temperature of between 20° and 450° C. and at a pressure substantially identical to the pressure of stage b), in order to obtain at least a first gaseous effluent, and the liquid effluent, a part of which is recycled upstream of stage a), d) a separation stage, fed with the first gaseous effluent and another part of the liquid effluent resulting from stage c) and an aqueous solution, said stage being carried out at a temperature of between 20 and less than 200° C. and at a pressure substantially identical to or less than the pressure of stage c), in order to obtain at least a second gaseous effluent, an aqueous effluent and a hydrocarbon effluent, e) optionally a stage of fractionation of all or part of the hydrocarbon effluent resulting from stage d), in order to obtain at least a third gaseous effluent and at least a first hydrocarbon cut comprising compounds having a boiling point of less than or equal to 175° C. and a second hydrocarbon cut comprising compounds having a boiling point of greater than 175° C., f) optionally, a hydrocracking stage carried out in a hydrocracking reaction section, employing at least one fixed-bed reactor having n catalytic beds, n being an integer greater than or equal to 1, each comprising at least one hydrocracking catalyst, said hydrocracking reaction section being fed with at least a part of said hydrocarbon effluent resulting from stage d) and/or with at least a part of the second hydrocarbon cut comprising compounds having a boiling point of greater than 175° C. resulting from stage e) and a third gas stream comprising hydrogen, said hydrocracking reaction section being employed at an average temperature between 25° and 450° C., a partial hydrogen pressure between 1.5 and 20.0 MPa abs. and an hourly space velocity between 0.1 and 10.0 $h^{-1}$, in order to obtain a first hydrocracked effluent.

One of the objectives of the present invention is to control the progress and the exothermicity of the reactions in the hydrogenation stage a), while ensuring the supply of heat necessary for the initiation and for the control of the different reactions and in particular the hydrogenation in stage a) requiring specific operating conditions with regard to temperature.

Another objective of the present invention is to maximize the recovery of energy by the recycle, under hot conditions and under elevated pressure, of a part of the liquid effluent resulting from stage c). This is because the energy in order to reach the inlet temperature necessary in stage a) is at least partly contributed by the heat of a part of the liquid effluent resulting from stage c), which makes it possible to achieve savings in costs but also to lower the $CO_2$ emissions.

The mixing of the feedstock and a part of the liquid effluent upstream of stage a) makes it possible to dilute the impurities in the feedstock but also makes possible indirect heating of the feedstock. The indirect heating of the feedstock makes it possible to avoid direct heating above a temperature of 200° C. on contact with a wall, which would cause hot spots of said feedstock, which would bring about the formation of gums and/or coke and which would cause fouling and an increase in the pressure drop of the system for heating the feedstock and also of the catalyst bed(s).

The present invention thus relates to a hydrotreating process scheme simultaneously making possible precise control of the reaction temperatures employed in the hydrogenation stage a) and in addition preferably the heating of the system in an indirect way, by the use of a recycle of hot liquid upstream of the hydrogenation stage a).

Another advantage of the process according to the invention is to remove chlorine in the form of ammonium chloride salts by the combination of the hot separation stage c) followed by the cold separation/washing stage d). The chloride ions, released by the hydrogenation of the chlorinated compounds in the form of HCl during stages a) and b) (hydrodechlorination), and the ammonia, generated by the hydrogenation of the nitrogenous compounds in the form of $NH_3$ during stage b) in particular (hydrodenitrogenation), leave in great part in the gas effluent by virtue of the hot separation of stage c). This is because the high temperature of this separation stage c) prevents the precipitation of ammonium chloride salts which are formed by reaction between the chloride ions and the ammonium ions. The separation at a lower temperature in stage d) of the gaseous effluent and of a part of the liquid effluent brings about the precipitation of these ammonium chloride salts. The washing with water of this stage d) makes it possible to dissolve these salts in the aqueous effluent. A hydrocarbon effluent freed from chlorine is thus obtained.

One advantage of the process according to the invention is that of purifying an oil resulting from the pyrolysis of plastic waste of at least a part of its impurities, which makes it possible to hydrogenate it and thus to be able to upgrade it in particular by incorporating it directly in the fuel storage unit or else by making it compatible with a treatment in a steam cracking unit in order to be able in particular to obtain light olefins with increased yields, which may act as monomers in the manufacture of polymers.

Another advantage of the invention is that of preventing risks of plugging and/or corrosion of the treatment unit in which the process of the invention is carried out, the risks being exacerbated by the presence, often in large amounts, of diolefins, metals and halogenated compounds in the plastics pyrolysis oil.

The process of the invention thus makes it possible to obtain a hydrocarbon effluent resulting from a plastics pyrolysis oil which is at least partly freed from the impurities of the starting plastics pyrolysis oil, thus limiting the problems of operability, such as the problems of corrosion, of coking or of catalytic deactivation, to which these impurities may give rise, in particular in steam cracking units and/or in units located downstream of the steam cracking units, in particular the polymerization and hydrogenation units. The removal of at least a part of the impurities from the oils resulting from the pyrolysis of plastic waste will also make it possible to increase the range of applications of the target polymers, the incompatibilities of uses being reduced.

According to an alternative form, the process comprises the fractionation stage e).

According to an alternative form, the process comprises the hydrocracking stage f).

According to an alternative form, in stage a), the hydrogen coverage is of between 250 and 800 $Sm^3$ of hydrogen per $m^3$ of feedstock ($Sm^3/m^3$).

According to an alternative form, at least a part of the liquid effluent resulting from the separation stage c) is preheated before being recycled upstream of the hydrogenation stage a).

According to an alternative form, the ratio by weight of the liquid effluent resulting from stage c) recycled in stage a) to the feedstock comprising a plastics pyrolysis oil is of between 0.01 and 10.

According to an alternative form, the process comprises a stage a0) of pretreatment of the feedstock comprising a plastics pyrolysis oil, said pretreatment stage being carried out upstream of the hydrogenation stage a), and comprises a filtration stage and/or an electrostatic separation stage and/or a stage of washing by means of an aqueous solution and/or an adsorption stage.

According to an alternative form, the hydrocarbon effluent resulting from the separation stage d), or at least one of the two liquid hydrocarbon cuts resulting from stage e), is sent, in all or part, to a steam cracking stage g) carried out in at least one pyrolysis furnace at a temperature of between 70° and 900° C. and at a pressure of between 0.05 and 0.3 MPa relative.

According to an alternative form, the reaction section of stage a) employs at least two reactors operating in permutable mode.

According to one alternative form, a stream containing an amine and/or a sulfur compound is injected upstream of stage a).

According to an alternative form, the gaseous effluent resulting from stages c), d) and/or e), and/or the liquid effluent from stage c) and/or the hydrocarbon effluent resulting from stage d) and/or the first and/or the second hydrocarbon cut resulting from stage e) is/are subjected to a stage of adsorption of heavy metals.

According to an alternative form, said hydrogenation catalyst comprises a support chosen from alumina, silica, silica-aluminas, magnesia, clays and their mixtures and a hydro-dehydrogenating function comprising either at least one element from group VIII and at least one element from group VIB, on the one hand, or at least one element from group VIII, on the other hand.

According to an alternative form, said hydrotreating catalyst comprises a support chosen from the group consisting of alumina, silica, silica-aluminas, magnesia, clays and their mixtures and a hydro-dehydrogenating function comprising at least one element from group VIII and/or at least one element from group VIB.

According to an alternative form, the process additionally comprises a second hydrocracking stage f') carried out in a hydrocracking reaction section, employing at least one fixed-bed reactor having n catalytic beds, n being an integer greater than or equal to 1, each comprising at least one hydrocracking catalyst, said hydrocracking reaction section being fed with at least a part of the first hydrocracked effluent resulting from the first hydrocracking stage f) and a gas stream comprising hydrogen, said hydrocracking reaction section being employed at a temperature between 25° and 450° C., a partial hydrogen pressure between 1.5 and 20.0 MPa abs. and an hourly space velocity between 0.1 and 10.0 $h^{-1}$, in order to obtain a second hydrocracked effluent.

According to an alternative form, said hydrocracking catalyst comprises a support chosen from halogenated aluminas, combinations of boron and aluminium oxides, amorphous silica-aluminas and zeolites and a hydro-dehydrogenating function comprising at least one metal from group VIB chosen from chromium, molybdenum and tungsten, alone or as a mixture, and/or at least one metal from group VIII chosen from iron, cobalt, nickel, ruthenium, rhodium, palladium and platinum.

The invention also relates to the product capable of being obtained and preferably obtained by the process according to the invention.

According to this alternative form, the product comprises, with respect to the total weight of the product:

- a total content of metal elements of less than or equal to 10.0 ppm by weight,
- including a content of iron element of less than or equal to 200 ppb by weight, and/or

- a content of silicon element of less than or equal to 5.0 ppm by weight, and/or
- a sulfur content of less than or equal to 500 ppm by weight, and/or
- a nitrogen content of less than or equal to 100 ppm by weight, and/or
- a content of chlorine element of less than or equal to 10 ppm by weight, and/or
- a mercury content of less than or equal to 5 ppb by weight.

According to the present invention, the pressures are absolute pressures, also written as abs., and are given in MPa absolute (or MPa abs.), unless otherwise indicated.

According to the present invention, the expressions "of between . . . and . . . " and "between . . . and . . . " are equivalent and mean that the limiting values of the interval are included in the described range of values. If such were not the case and if the limiting values were not included in the range described, such a clarification will be introduced by the present invention.

Within the meaning of the present invention, the various parameter ranges for a given stage, such as the pressure ranges and the temperature ranges, can be used alone or in combination. For example, within the meaning of the present invention, a range of preferred pressure values can be combined with a range of more preferred temperature values.

In the continuation, specific and/or preferred embodiments of the invention may be described. They can be implemented separately or combined together, without limitation of combination when this is technically feasible.

In what follows, the groups of chemical elements are given according to the CAS classification (CRC Handbook of Chemistry and Physics, published by CRC Press, editor-in-chief D. R. Lide, 81$^{st}$ edition, 2000-2001). For example, group VIII according to the CAS classification corresponds to the metals of columns 8, 9 and 10 according to the new IUPAC classification.

The content of metals is measured by X-ray fluorescence.

DETAILED DESCRIPTION

The Feedstock

According to the invention, a "plastics pyrolysis oil" is an oil, advantageously in liquid form at ambient temperature, resulting from the pyrolysis of plastics, preferably of plastic waste originating in particular from collection and sorting channels. It can also result from the pyrolysis of worn tyres.

It comprises in particular a mixture of hydrocarbon compounds, especially paraffins, mono- and/or diolefins, naphthenes and aromatics. At least 80% by weight of these hydrocarbon compounds preferably have a boiling point of less than 700° C., and preferably of less than 550° C. In particular, according to the origin of the pyrolysis oil, the latter can comprise up to 70% by weight of paraffins, up to 90% by weight of olefins and up to 90% by weight of aromatics, it being understood that the sum of the paraffins, of the olefins and of the aromatics is 100% by weight of the hydrocarbon compounds.

The density of the pyrolysis oil, measured at 15° C. according to the ASTM D4052 method, is generally of between 0.75 and 0.99 g/cm$^3$, preferably of between 0.75 and 0.95 g/cm$^3$.

The plastics pyrolysis oil can additionally comprise, and generally comprises, impurities, such as metals, in particular iron, silicon or halogenated compounds, in particular chlorinated compounds. These impurities can be present in the plastics pyrolysis oil at high contents, for example up to 350 ppm by weight or even 700 ppm by weight, indeed even 1000 ppm by weight, of halogen elements (in particular chlorine) contributed by halogenated compounds, and up to 100 ppm by weight, indeed even 200 ppm by weight, of metal or semimetal elements. Alkali metals, alkaline earth metals, transition metals, p-block metals and metalloids can be likened to contaminants of metal nature, referred to as metals or metal or semimetal elements. In particular, the metals or metal or semimetal elements possibly contained in the oils resulting from the pyrolysis of plastic waste comprise silicon, iron or both these elements. The plastics pyrolysis oil can also comprise other impurities, such as heteroelements contributed in particular by sulfur compounds, oxygen compounds and/or nitrogen compounds, at contents generally of less than 10 000 ppm by weight of heteroelements and preferably of less than 4000 ppm by weight of heteroelements. The plastics pyrolysis oil can also comprise other impurities, such as heavy metals, for example mercury, arsenic, zinc and lead, for example up to 100 ppb by weight or also 200 ppb by weight of mercury.

The feedstock of the process according to the invention comprises at least one plastics pyrolysis oil. Said feedstock can consist solely of plastics pyrolysis oil(s). Preferably, said feedstock comprises at least 50% by weight, in a preferred way between 70% and 100% by weight, of plastics pyrolysis oil, with respect to the total weight of the feedstock, that is to say preferably between 50% and 100% by weight and in a preferred way between 70% and 100% by weight of plastics pyrolysis oil.

The feedstock of the process according to the invention can comprise, in addition to the plastics pyrolysis oil(s), a conventional petroleum feedstock or a feedstock resulting from the conversion of biomass which is then cotreated with the plastics pyrolysis oil of the feedstock.

The conventional petroleum feedstock can advantageously be a cut or a mixture of cuts of naphtha, gas oil or vacuum gas oil type.

The feedstock resulting from the conversion of biomass can advantageously be chosen from vegetable oils, oils from algae or algal oils, fish oils, waste food oils, and fats of vegetable or animal origin, or mixtures of such feedstocks. Said vegetable oils can advantageously be totally or partly raw or refined, and result from plants chosen from rape, sunflower, soybean, palm, olive, coconut, copra, castor oil plant, cotton plant, peanut oil, linseed oil and sea kale oil, and all the oils resulting, for example, from sunflower or rape by genetic modification or hybridization, this list not being limiting. Said animal fats are advantageously chosen from blubber and fats composed of residues from the food industry or resulting from the catering industries. Frying oils, various animal oils, such as fish oils, tallow or lard, can also be used.

The feedstock resulting from the conversion of biomass can also be chosen from feedstocks originating from processes for thermal or catalytic conversions of biomass, such as oils which are produced from biomass, in particular from lignocellulosic biomass, with various liquefaction methods, such as hydrothermal liquefaction or pyrolysis. The term "biomass" refers to a material derived from recently living organisms, which comprises plants, animals and their by-products. The term "lignocellulosic biomass" denotes biomass derived from plants or from their by-products. The lignocellulosic biomass is composed of carbohydrate polymers (cellulose, hemicellulose) and of an aromatic polymer (lignin).

The feedstock resulting from the conversion of biomass can also advantageously be chosen from feedstocks resulting from the papermaking industry.

The plastics pyrolysis oil can result from a thermal or catalytic pyrolysis treatment or also be prepared by hydropyrolysis (pyrolysis in the presence of a catalyst and of hydrogen).

Pretreatment (Optional)

Said feedstock comprising a plastics pyrolysis oil can advantageously be pretreated in an optional pretreatment stage a0), prior to the hydrogenation stage a), in order to obtain a pretreated feedstock which feeds stage a).

This optional pretreatment stage a0) makes it possible to reduce the amount of contaminants and of solid particles, in particular the amount of iron and/or of silicon and/or of chlorine, possibly present in the feedstock comprising a plastics pyrolysis oil. Thus, an optional stage a0) of pretreatment of the feedstock comprising a plastics pyrolysis oil is advantageously carried out, especially when said feedstock comprises more than 10 ppm by weight, in particular more than 20 ppm by weight, more particularly more than 50 ppm by weight, of metal elements and/or of solid particles, and especially when said feedstock comprises more than 5 ppm by weight of silicon, more particularly more than 10 ppm by weight, indeed even more than 20 ppm by weight, of silicon. Likewise, an optional step a0) of pretreatment of the feedstock comprising a plastics pyrolysis oil is advantageously carried out especially when said feedstock comprises more than 10 ppm by weight, in particular more than 20 ppm by weight, more particularly more than 50 ppm by weight, of chlorine.

Said optional pretreatment stage a0) can be carried out by any method known to a person skilled in the art which makes it possible to reduce the amount of contaminants. It can in particular comprise a filtration stage and/or an electrostatic separation stage and/or a stage of washing by means of an aqueous solution and/or an adsorption stage.

Said optional pretreatment stage a0) is advantageously carried out at a temperature between 0 and 150° C., preferably between 5 and 100° C., and at a pressure between 0.15 and 10.0 MPa abs., preferably between 0.2 and 1.0 MPa abs.

According to an alternative form, said optional pretreatment stage a0) is carried out in an adsorption section operated in the presence of at least one adsorbent, preferably of alumina type, having a specific surface of greater than or equal to 100 $m^2/g$, preferably of greater than or equal to 200 $m^2/g$. The specific surface of said at least one adsorbent is advantageously less than or equal to 600 $m^2/g$, in particular less than or equal to 400 $m^2/g$. The specific surface of the adsorbent is a surface area measured by the BET method, that is to say the specific surface determined by nitrogen adsorption in accordance with Standard ASTM D 3663-78 drawn up from the Brunauer-Emmett-Teller method described in the periodical *The Journal of the American Chemical Society,* 6Q, 309 (1938).

Advantageously, said adsorbent comprises less than 1% by weight of metal elements and preferably is devoid of metal elements. Metal elements of the adsorbent should be understood as meaning the elements from groups 6 to 10 of the Periodic Table of the Elements (new IUPAC classification). The residence time of the feedstock in the adsorption section is generally of between 1 and 180 minutes.

Said adsorption section of the optional stage a0) comprises at least one adsorption column, preferably comprises at least two adsorption columns, preferentially between two and four adsorption columns, containing said adsorbent. When the adsorption section comprises two adsorption columns, one operating mode can be a "swing" operation, in which one of the columns is on-line, that is to say in operation, while the other column is in reserve. When the adsorbent of the on-line column is spent, this column is isolated, while the column in reserve is placed on-line, that is to say in operation. The spent adsorbent can subsequently be regenerated in situ and/or replaced with fresh adsorbent in order for the column containing it to be again able to be placed back on-line once the other column has been isolated.

Another operating mode is to have at least two columns operating in series. When the adsorbent of the column placed at the head is spent, this first column is isolated and the spent adsorbent is either regenerated in situ or replaced with fresh adsorbent. The column is subsequently brought back on-line in the last position, and so on. This operation is known as permutable mode, or according to the term PRS for Permutable Reactor System, or also "lead and lag". The combination of at least two adsorption columns makes it possible to overcome the possible and possibly rapid poisoning and/or clogging of the adsorbent due to the combined action of the metal contaminants, of the diolefins, of the gums resulting from the diolefins and of the insoluble materials which may be present in the plastics pyrolysis oil to be treated. This is because the presence of at least two adsorption columns facilitates the replacement and/or the regeneration of the adsorbent, advantageously without shutdown of the pretreatment unit, indeed even of the process, thus making it possible to reduce the risks of clogging and thus to avoid shutdown of the unit due to clogging, to control the costs and to limit the consumption of adsorbent.

According to another alternative form, said optional pretreatment stage a0) is carried out in a section for washing with an aqueous solution, for example water, or an acidic or basic solution. This washing section can comprise items of equipment which make it possible to bring the feedstock into contact with the aqueous solution and to separate the phases so as to obtain, on the one hand, the pretreated feedstock and, on the other hand, the aqueous solution comprising impurities. Among these items of equipment, there may be, for example, a stirred reactor, a decanter, a mixer-decanter and/or a cocurrent or countercurrent washing column.

Said optional pretreatment stage a0) can also be optionally fed by at least a part of the liquid effluent resulting from stage c) of the process and/or a part of the first hydrocarbon cut comprising compounds having a boiling point of less than or equal to 175° C. resulting from stage e) and/or a part of the second hydrocarbon cut comprising compounds having a boiling point of greater than 175° C. resulting from stage e), as a mixture with or separately from the feedstock comprising a plastics pyrolysis oil. The recycle of at least a part of the liquid effluent resulting from stage c) makes it possible in particular to increase the sedimentation and thus, after an optional filtration, to improve the pretreatment of the feedstock.

Said optional pretreatment stage a0) thus makes it possible to obtain a pretreated feedstock which subsequently feeds the hydrogenation stage a).

Hydrogenation Stage a)

According to the invention, the process comprises a hydrogenation stage a) carried out in a hydrogenation reaction section, employing at least one fixed-bed reactor having n catalytic beds, n being an integer greater than or equal to 1, each comprising at least one hydrogenation catalyst, said hydrogenation reaction section being fed at least with said feedstock, which is optionally pretreated, as a mixture with at least a part of a liquid effluent resulting from stage c) and a first gas stream comprising hydrogen, said hydrogenation reaction section being employed at an average temperature between 14° and 400° C., a partial hydrogen pressure between 1.0 and 10.0 MPa abs. and an hourly space velocity between 0.1 and 10.0 $h^{-1}$, in order to obtain a hydrogenated effluent.

Stage a) is in particular carried out under temperature and hydrogen pressure conditions which make it possible to carry out the hydrogenation of the diolefins and olefins at the beginning of the hydrogenation reaction section, while making it possible, by an increasing profile of the temperature, to carry out the hydrodemetallization and the hydrodechlorination, in particular at the end of the hydrogenation reaction section. A necessary amount of hydrogen is injected so as to make possible the hydrogenation of at least a part of the diolefins and olefins present in the plastics pyrolysis oil, the hydrodemetallization of at least a part of the metals, notably the retention of silicon, and also the conversion of at least a part of the chlorine (to give HCl). The hydrogenation of the diolefins and olefins thus makes it possible to avoid or at least to limit the formation of "gums", that is to say the polymerization of the diolefins and olefins and thus the formation of oligomers and polymers, which can plug the reaction section of the hydrotreating stage b). In parallel with the hydrogenation, the hydrodemetallization, and in particular the retention of silicon during stage a), makes it possible to limit the catalytic deactivation of the reaction section of the hydrotreating stage b). Furthermore, the conditions of stage a) make it possible to convert at least a part of the chlorine.

The control of the temperature is important in this stage and must satisfy an antagonistic constraint. On the one hand, the inlet temperature and the temperature throughout the hydrogenation reaction section must be sufficiently low in order to make possible the hydrogenation of the diolefins and olefins at the beginning of the hydrogenation reaction section. On the other hand, the inlet temperature of the hydrogenation reaction section must be sufficiently high in order to prevent deactivation of the catalyst. As the hydrogenation reactions, in particular the hydrogenation of a part of the olefins and diolefins, are highly exothermic, an increasing profile of the temperature is then observed in the hydrogenation reaction section. This higher temperature at the end of said section makes it possible to carry out the hydrodemetallization and hydrodechlorination reactions. Thus, the outlet temperature of the reaction section of stage a) is greater than the inlet temperature of the reaction section of stage a), generally by at least 3° C., preferably by at least 5° C.

The temperature in stage a), whether this is the average temperature (WABT), the inlet temperature of the reaction section or also the rise in the temperature in stage a) between inlet and outlet of the reaction section, can in particular be controlled by the rate of recycle of a part of the liquid effluent resulting from stage c) and/or by the temperature of the recycled effluent.

The difference in temperature between the inlet and the outlet of the reaction section of stage a) is compatible with injection of a gaseous (hydrogen) or liquid cooling stream, in particular a part of the liquid effluent resulting from stage c).

The difference in temperature between the inlet and the outlet of the reaction section of stage a) is exclusively due to the exothermicity of the chemical reactions carried out in the reaction section and is thus compatible with the non-use of a heating means (oven, heat exchanger, and the like).

The inlet temperature of the reaction section of stage a) is of between 135 and 397° C., preferably between 24° and 347° C.

The outlet temperature of the reaction section of stage a) is between 138 and 400° C., preferably between 243 and 350° C.

According to the invention, it is advantageous to carry out the hydrogenation of the diolefins and a part of the hydrodemetallization reactions in one and the same stage and at a temperature sufficient to limit the deactivation of the catalyst of stage a), which manifests itself by a decrease in the conversion of the diolefins. This same stage also makes it possible to benefit from the heat from hydrogenation reactions, in particular reactions for hydrogenation of a part of the olefins and diolefins, so as to have an increasing temperature profile in this stage and thus to be able to eliminate the need for a heating device between the catalytic hydrogenation section and the catalytic hydrotreating section.

Said reaction section carries out a hydrogenation in the presence of at least one hydrogenation catalyst, advantageously at an average temperature (or WABT as defined below) between 14° and 400° C., preferably between 24° and 350° C. and particularly preferably between 26° and 330° C., a partial hydrogen pressure between 1.0 and 10.0 MPa abs., preferably between 1.5 and 8.0 MPa abs., and at an hourly space velocity (HSV) between 0.1 and 10.0 $h^1$, preferably between 0.2 and 5.0 $h^1$ and very preferably between 0.3 and 3.0 $h^1$.

According to the invention, the "average temperature" of a reaction section corresponds to the weight-average bed temperature (WABT), which is well known to a person skilled in the art. The average temperature is advantageously determined as a function of the catalytic systems, of the items of equipment, of the configuration of these, which are used. The average temperature (or WABT) is calculated in the following way:

$$WABT = (T_{inlet} + T_{outlet})/2$$

with $T_{inlet}$: the temperature of the effluent at the inlet of the reaction section, $T_{outlet}$: the temperature of the effluent at the outlet of the reaction section. Unless otherwise indicated, the "average temperature" of a reaction section is given at cycle beginning conditions.

The hourly space velocity (HSV) is defined here as the ratio of the hourly flow rate by volume of the feedstock comprising the plastics pyrolysis oil, which has optionally been pretreated, to the volume of catalyst(s).

The hydrogen coverage is defined as the ratio of the flow rate by volume of hydrogen, taken under standard temperature and pressure conditions, with respect to the flow rate by volume of "fresh" feedstock, that is to say of the feedstock to be treated, which has optionally been pretreated, without taking into account a recycled fraction, and in particular without taking into account the recycled liquid effluent resulting from stage c), at 15° C. (in standard $m^3$, denoted $Sm^3$, of $H_2$ per $m^3$ of feedstock).

The amount of the gas stream comprising hydrogen ($H_2$) feeding said reaction section of stage a) is advantageously such that the hydrogen coverage is between 100 and 1500 $Sm^3$ of hydrogen per $m^3$ of feedstock ($Sm^3/m^3$), preferably between 200 and 1000 $Sm^3$ of hydrogen per $m^3$ of feedstock ($Sm^3/m^3$), in a preferred way between 250 and 800 $Sm^3$ of hydrogen per $m^3$ of feedstock ($Sm^3/m^3$).

Advantageously, the reaction section of said stage a) comprises between 1 and 5 reactors, preferably between 2 and 5 reactors, and particularly preferably it comprises two reactors. The advantage of a hydrogenation reaction section comprising several reactors lies in an optimized treatment of the feedstock, while making it possible to reduce the risks of clogging of the catalytic bed(s) and thus to avoid shutdown of the unit due to clogging.

According to a preferred alternative form, these reactors operate in permutable mode, known as PRS for Permutable Reactor System, or also "lead and lag". The combination of at least two reactors in PRS mode makes it possible to isolate a reactor, to discharge the spent catalyst, to recharge the reactor with fresh catalyst and to bring said reactor back into service without shutting down the process. The PRS technology is described in particular in Patent FR 2 681 871.

According to a particularly preferred alternative form, the hydrogenation reaction section of stage a) comprises two reactors operating in permutable mode.

Advantageously, reactor internals, for example of filter plate type, can be used to prevent the plugging of the reactor(s). An example of a filter plate is described in Patent FR 3 051 375.

Advantageously, said hydrogenation catalyst comprises a support, preferably an inorganic support, and a hydro-dehydrogenating function.

According to an alternative form, the hydro-dehydrogenating function comprises in particular at least one element from group VIII, preferably chosen from nickel and cobalt, and at least one element from group VIB, preferably chosen from molybdenum and tungsten. According to this alternative form, the total content, expressed as oxides, of the metal elements from groups VIB and VIII is preferably of between 1% and 40% by weight, preferentially from 5% to 30% by weight, with respect to the total weight of the catalyst. When the metal is cobalt or nickel, the metal content is expressed as CoO and NiO respectively. When the metal is molybdenum or tungsten, the metal content is expressed as $MoO_3$ and $WO_3$ respectively.

The ratio by weight, expressed as metal oxide, of the metal (or metals) from group VIB with respect to the metal (or metals) from group VIII is preferably of between 1 and 20 and in a preferred way between 2 and 10.

According to this alternative form, the reaction section of said stage a) comprises, for example, a hydrogenation catalyst comprising between 0.5% and 12% by weight of nickel, preferably between 0.9% and 10% by weight of nickel (expressed as nickel oxide NiO with respect to the weight of said catalyst), and between 1% and 30% by weight of molybdenum, preferably between 3% and 20% by weight of molybdenum (expressed as molybdenum oxide $MoO_3$ with respect to the weight of said catalyst), on a preferably inorganic support, preferably on an alumina support.

According to another alternative form, the hydro-dehydrogenating function comprises, and preferably consists of, at least one element from group VIII, preferably nickel. According to this alternative form, the content of nickel oxides is preferably of between 1% and 50% by weight, preferably between 10% and 30% by weight, with respect to the weight of said catalyst. This type of catalyst is preferably used in its reduced form, on a preferably inorganic support, preferably on an alumina support.

The support of said hydrogenation catalyst is preferably chosen from alumina, silica, silica-aluminas, magnesia, clays and their mixtures. Said support can include dopant compounds, in particular oxides chosen from boron oxide, especially boron trioxide, zirconia, ceria, titanium oxide, phosphorus pentoxide and a mixture of these oxides. Preferably, said hydrogenation catalyst comprises an alumina support, optionally doped with phosphorus and optionally boron. When phosphorus pentoxide $P_2O_5$ is present, its concentration is less than 10% by weight, with respect to the weight of the alumina, and advantageously at least 0.001% by weight, with respect to the total weight of the alumina. When boron trioxide $B_2O_3$ is present, its concentration is less than 10% by weight, with respect to the weight of the alumina, and advantageously at least 0.001% by weight, with respect to the total weight of the alumina. The alumina used can, for example, be a $\gamma$ (gamma) or $\eta$ (eta) alumina.

Said hydrogenation catalyst is, for example, in the form of extrudates.

Very preferably, stage a) can employ, in addition to the hydrogenation catalyst(s) described above, moreover at least one hydrogenation catalyst used in stage a) comprising less than 1% by weight of nickel and at least 0.1% by weight of nickel, preferably 0.5% by weight of nickel, expressed as nickel oxide NiO with respect to the weight of said catalyst, and less than 5% by weight of molybdenum and at least 0.1% by weight of molybdenum, preferably 0.5% by weight of molybdenum, expressed as molybdenum oxide $MoO_3$ with respect to the weight of said catalyst, on an alumina support. This catalyst, not highly loaded with metals, can be preferably placed upstream or downstream of the hydrogenation catalyst(s) described above.

Said hydrogenation stage a) makes it possible to obtain a hydrogenated effluent, that is to say an effluent having a reduced content of olefins, in particular of diolefins, and of metals, in particular of silicon. The content of impurities, in particular of diolefins, of the hydrogenated effluent obtained on conclusion of stage a) is reduced with respect to that of the same impurities, in particular diolefins, included in the feedstock of the process. The hydrogenation stage a) generally makes it possible to convert at least 40% and preferably at least 60% of the diolefins and also at least 40% and preferably at least 60% of the olefins contained in the initial feedstock. The heat given off by the saturation of the double bonds makes it possible to raise the temperature of the reaction medium and to initiate the hydrotreating reactions, in particular the removal, at least partly, of other contaminants, such as, for example, silicon and chlorine. Preferably, at least 50% and more preferentially at least 75% of the chlorine and of the silicon of the initial feedstock are removed during stage a). The hydrogenated effluent, obtained on conclusion of the hydrogenation stage a), is sent, preferably directly, to the hydrotreating stage b).

Hydrotreating Stage b)

According to the invention, the treatment process comprises a hydrotreating stage b) carried out in a hydrotreating reaction section, employing at least one fixed-bed reactor having n catalytic beds, n being an integer greater than or equal to 1, each comprising at least one hydrotreating catalyst, said hydrotreating reaction section being fed at least with said hydrogenated effluent resulting from stage a) and a second gas stream comprising hydrogen, said hydrotreating reaction section being employed at an average temperature between 25° and 430° C., a partial hydrogen pressure between 1.0 and 10.0 MPa abs. and an hourly space velocity between 0.1 and 10.0 $h^{1}$, in order to obtain a hydrotreated effluent.

Advantageously, stage b) employs the hydrotreating reactions well known to a person skilled in the art, and more particularly hydrotreating reactions such as the hydrogenation of aromatics, hydrodesulfurization and hydrodenitrogenation. Furthermore, the hydrogenation of the remaining halogenated compounds and olefins and also the hydrodemetallization are continued.

Said hydrotreating reaction section is advantageously employed at a pressure equivalent to that used in the reaction section of the hydrogenation stage a), and generally at a higher average temperature than that of the reaction section of the hydrogenation stage a). Thus, said hydrotreating reaction section is advantageously employed at an average hydrotreating temperature between 25° and 430° C., preferably between 28° and 380° C., at a hydrogen partial pressure between 1.0 and 10.0 MPa abs. and at an hourly space velocity (HSV) between 0.1 and 10.0 $h^1$, preferably between 0.1 and 5.0 $h^1$, preferentially between 0.2 and 2.0 $h^1$, in a preferred way between 0.2 and 1 $h^1$. The hydrogen coverage in stage b) is advantageously of between 100 and 1500 $Sm^3$ of hydrogen per $m^3$ of fresh feedstock which feeds stage a), preferably between 200 and 1000 $Sm^3$ of hydrogen per $m^3$ of fresh feedstock which feeds stage a) and in a preferred way between 250 and 800 $Sm^3$ of hydrogen per $m^3$ of fresh feedstock which feeds stage a). The definitions of the average temperature (WABT), of the HSV and of the hydrogen coverage correspond to those described above.

Said hydrotreating reaction section is fed at least with said hydrogenated effluent resulting from stage a) and a second gas stream comprising hydrogen, advantageously at the level of the first catalytic bed of the first operating reactor. Optionally, the reaction section of said stage b) can furthermore also be fed with at least a part of the liquid effluent resulting from stage c).

Advantageously, said stage b) is carried out in a hydrotreating reaction section comprising at least one, preferably between one and five, fixed-bed reactor(s) having n catalytic beds, n being an integer greater than or equal to one, preferably of between one and ten, in a preferred way of between two and five, said bed(s) each comprising at least one, and preferably not more than ten, hydrotreating catalyst(s). When a reactor comprises several catalytic beds, that is to say at least two, preferably between two and ten, in a preferred way between two and five, catalytic beds, said catalytic beds are preferably arranged in series in said reactor.

When stage b) is carried out in a hydrotreating reaction section comprising several reactors, preferably two reactors, these reactors can operate in series and/or in parallel and/or in permutable (or PRS) mode and/or in swing mode. The various optional operating modes, PRS mode (or lead and lag) and swing mode, are well known to a person skilled in the art and are advantageously defined above.

In another embodiment of the invention, said hydrotreating reaction section comprises a single fixed-bed reactor containing n catalytic beds, n being an integer greater than or equal to one, preferably of between one and ten, in a preferred way of between two and five.

In a particularly preferred embodiment, the hydrogenation reaction section of stage a) comprises two reactors operating in permutable mode, followed by the hydrotreating reaction section of stage b) which comprises a single fixed-bed reactor.

Advantageously, said hydrotreating catalyst used in said stage b) can be chosen from known hydrodemetallization, hydrotreating or silicon-scavenging catalysts used in particular for the treatment of petroleum cuts, and their combinations. Known hydrodemetallization catalysts are, for example, those described in Patents EP 0 113 297, EP 0 113 284, U.S. Pat. Nos. 5,221,656, 5,827,421, 7,119,045, 5,622,616 and 5,089,463. Known hydrotreating catalysts are, for example, those described in Patents EP 0 113 297, EP 0 113 284, U.S. Pat. No. 6,589,908, 4,818,743 or 6,332,976. Known silicon-scavenging catalysts are, for example, those described in Patent Applications CN 102051202 and US 2007/080099.

In particular, said hydrotreating catalyst comprises a support, preferably an inorganic support, and at least one metal element having a hydro-dehydrogenating function. Said metal element having a hydro-dehydrogenating function advantageously comprises at least one element from group VIII, preferably chosen from the group consisting of nickel and cobalt, and/or at least one element from group VIB, preferably chosen from the group consisting of molybdenum and tungsten. The total content, expressed as oxides, of the metal elements from groups VIB and VIII is preferably between 0.1% and 40% by weight, preferentially from 5% to 35% by weight, with respect to the total weight of the catalyst. When the metal is cobalt or nickel, the metal content is expressed as CoO and NiO respectively. When the metal is molybdenum or tungsten, the metal content is expressed as $MoO_3$ and $WO_3$ respectively. The ratio by weight, expressed as metal oxide, of the metal (or metals) from group VIB, with respect to the metal (or metals) from group VIII, is preferably of between 1.0 and 20, in a preferred way between 2.0 and 10. For example, the hydrotreating reaction section of stage b) of the process comprises a hydrotreating catalyst comprising between 0.5% and 10% by weight of nickel, preferably between 1% and 8% by weight of nickel, expressed as nickel oxide NiO with respect to the total weight of the hydrotreating catalyst, and between 1.0% and 30% by weight of molybdenum, preferably between 3.0% and 29% by weight of molybdenum, expressed as molybdenum oxide $MoO_3$ with respect to the total weight of the hydrotreating catalyst, on an inorganic support, preferably on an alumina support.

The support of said hydrotreating catalyst is advantageously chosen from alumina, silica, silica-aluminas, magnesia, clays and their mixtures. Said support can additionally include dopant compounds, in particular oxides chosen from boron oxide, especially boron trioxide, zirconia, ceria, titanium oxide, phosphorus pentoxide and a mixture of these oxides. Preferably, said hydrotreating catalyst comprises an alumina support, in a preferred way an alumina support doped with phosphorus and optionally boron. When phosphorus pentoxide $P_2O_5$ is present, its concentration is less than 10% by weight, with respect to the weight of the alumina, and advantageously at least 0.001% by weight, with respect to the total weight of the alumina. When boron trioxide $B_2O_3$ is present, its concentration is less than 10% by weight, with respect to the weight of the alumina, and advantageously at least 0.001% by weight, with respect to the total weight of the alumina. The alumina used can, for example, be a γ (gamma) or η (eta) alumina.

Said hydrotreating catalyst is, for example, in the form of extrudates.

Advantageously, said hydrotreating catalyst used in stage b) of the process exhibits a specific surface of greater than or equal to 250 $m^2/g$, preferably of greater than or equal to 300 $m^2/g$. The specific surface of said hydrotreating catalyst is advantageously less than or equal to 800 $m^2/g$, preferably less than or equal to 600 $m^2/g$, in particular less than or equal to 400 $m^2/g$. The specific surface of the hydrotreating catalyst is measured by the BET method, that is to say the specific surface determined by nitrogen adsorption in accordance with Standard ASTM D 3663-78 drawn up from the Brunauer-Emmett-Teller method described in the periodical *The Journal of the American Chemical Society,* 60, 309

(1938). Such a specific surface makes it possible to further improve the removal of the contaminants, in particular of the metals, such as silicon.

According to another aspect of the invention, the hydrotreating catalyst as described above additionally comprises one or more organic compounds containing oxygen and/or nitrogen and/or sulfur. Such a catalyst is often denoted by the term "additivated catalyst". Generally, the organic compound is chosen from a compound comprising one or more chemical functions chosen from a carboxyl, alcohol, thiol, thioether, sulfone, sulfoxide, ether, aldehyde, ketone, ester, carbonate, amine, nitrile, imide, oxime, urea and amide function or also compounds including a furan ring or also sugars.

Advantageously, the hydrotreating stage b) makes possible the hydrogenation of at least 80% and preferably of all of the remaining olefins after the hydrogenation stage a), but also the at least partial conversion of other impurities present in the feedstock, such as aromatic compounds, metal compounds, sulfur compounds, nitrogen compounds, halogen compounds (in particular chlorine compounds) and oxygen compounds. Preferably, the nitrogen content at the outlet of stage b) is less than 100 ppm by weight. Stage b) can also make it possible to further reduce the content of contaminants, such as that of metals, in particular the silicon content. Preferably, the metal content at the outlet of stage b) is less than 10 ppm by weight and in a preferred way less than 2 ppm by weight, and the silicon content is less than 5 ppm by weight.

Depending on the content of sulfur compounds in the initial feedstock to be treated, a stream containing a sulfiding agent can be injected upstream of the hydrogenation stage a) and/or the hydrotreating stage b) and/or upstream of one of the hydrocracking stages, when they are present, preferably upstream of the hydrogenation stage a) and/or the hydrotreating stage b), in order to ensure a sufficient amount of sulfur to form or maintain the active entity of the catalyst (in sulfided form). This activation or sulfidation stage is carried out by methods well known to a person skilled in the art, and advantageously under a sulfo-reductive atmosphere in the presence of hydrogen and hydrogen sulfide. The sulfiding agents are preferably $H_2S$ gas, elemental sulfur, $CS_2$, mercaptans, sulfides and/or polysulfides, hydrocarbon cuts having a boiling point of less than 400° C. containing sulfur compounds or any other sulfur-containing compound used for the activation of hydrocarbon feedstocks with a view to sulfiding the catalyst. Said sulfur-containing compounds are advantageously chosen from alkyl disulfides, such as, for example, dimethyl disulfide (DMDS), alkyl sulfides, such as, for example, dimethyl sulfide, thiols, such as, for example, n-butyl mercaptan (or 1-butanethiol), and polysulfide compounds of tert-nonyl polysulfide type. The catalyst can also be sulfided by the sulfur contained in the feedstock to be desulfurized. Preferably, the catalyst is sulfided in situ in the presence of a sulfiding agent and of a hydrocarbon feedstock. Very preferably, the catalyst is sulfided in situ in the presence of the feedstock additivated with dimethyl disulfide.

Separation Stage c)

According to the invention, the treatment process comprises a separation stage c), fed with the hydrotreated effluent resulting from stage b), said stage being carried out at a temperature of between 20° and 450° C. and at a pressure substantially identical to the pressure of stage b), in order to obtain at least a first gaseous effluent, and the liquid effluent, a part of which is recycled upstream of stage a).

The separation stage c) is a separation stage said to be a high-pressure or medium-pressure high-temperature separation stage, also known to a person skilled in the art under the name HHPS (Hot High Pressure Separator). Thus, this stage c) preferably employs a "hot high-pressure" separator, the pressure being substantially equal to the operating pressure of stage b). The term "pressure substantially equal to the pressure of stage b)" is understood to mean the pressure of stage b) with a pressure difference of between 0 and 1 MPa, preferably of between 0.005 and 0.3 MPa and particularly preferably of between 0.01 and 0.2 MPa, with respect to the pressure of stage b). Preferably, the pressure of stage c) is the pressure of stage b) decreased by pressure drops.

The temperature at which the separation is carried out is of between 20° and 450° C., preferably of between 22° and 330° C. and particularly preferably of between 24° and 300° C. According to a preferred alternative form, and with a view to recovering the most heat, the separation is carried out at a temperature which is the highest possible but less than or equal to the outlet temperature of stage b), which makes it possible to avoid or to limit reheating (and thus a need for heat) of the effluent from stage b). According to another alternative form, the effluent from stage b) can be reheated or cooled before the separation.

Advantageously, the amount of recycled liquid effluent resulting from stage c), that is to say the recycled fraction of product obtained, is adjusted so that the ratio by weight of the recycle stream from stage c) to the feedstock comprising a plastics pyrolysis oil, that is to say the feedstock to be treated feeding the overall process, is less than or equal to 10, preferably less than or equal to 7, and preferentially greater than or equal to 0.001, preferably greater than or equal to 0.01 and in a preferred way greater than or equal to 0.1. Preferably, the amount of recycled liquid effluent resulting from stage c) is adjusted so that the ratio by weight of the recycle stream to the feedstock comprising a plastics pyrolysis oil is of between 0.01 and 10, preferably of between 0.1 and 7 and particularly preferably of between 0.2 and 5. This recycle rate makes it possible to control the rise in the temperature in stage a). This is because, when the recycle rate is high, the rate of dilution of the feedstock is high, and the rise in temperature at the beginning of the reaction section of stage a), in particular due to the hydrogenation reactions of the diolefins, is thus controllable by the dilution effect.

The separation stage can advantageously be carried out by any method known to a person skilled in the art, such as, for example, the combination of one or more separator(s) (drum(s)) and/or one or more stripping columns, which separator(s) (drum(s)) and/or columns can optionally be fed with a stripping gas, for example a hydrogen-rich gas stream. Preferably, stage c) is carried out with a single separator (drum).

The high-pressure and high-temperature separation makes it possible, on the one hand, to maximize the recovery of energy by the hot recycle of a part of the liquid effluent. This is because the energy in order to reach the inlet temperature necessary in stage a) is at least partly contributed by the heat of a part of the liquid effluent resulting from stage c) and also makes it possible to reduce, indeed even eliminate, an optional preheating by direct heating of the feedstock beyond a temperature of greater than 200° C. in order to prevent the formation of gums. Furthermore, the fact of recycling at least a part of the liquid effluent at high pressure makes it possible to economize on energy for its pressurization in stage a).

The high-pressure and high-temperature separation makes it possible, on the other hand, to minimize the amount of light fraction (hydrocarbon cut comprising compounds having a boiling point of less than or equal to 175° C. or naphtha) contained in the liquid effluent recycled in stage a). At this temperature, virtually all of the light fraction of the effluent (naphtha) leaves as gaseous effluent to the separation/washing stage d), whereas, as liquid phase, there is predominantly the heavy fraction of the feedstock (hydrocarbon cut comprising compounds having a boiling point of greater than 175° C. or middle distillates). In this way, the pH2p is favoured in stage a) because the light fraction (naphtha) might evaporate partly and lower the pH2p if it were not at least partly removed during the high-pressure and high-temperature separation. The removal of the light fraction comprising naphtha can optionally be increased by a slight pressure reduction upstream of at least one separator used in stage c), even if this use is not preferred as a result of the energy loss linked to the pressure reduction. Another option for increasing the removal of the light faction comprising naphtha can consist in carrying out a stripping, for example by injecting a hydrogen-rich gas in stage c).

According to a preferred alternative form, at least a part of the hydrotreated liquid effluent resulting from stage c) can advantageously be either cooled, or preheated, if necessary, or kept at the same temperature as at the outlet of the separation stage c), before being recycled upstream of the hydrogenation stage a), according to the temperature and the flow rate of feedstock and hydrogen, so that the temperature of the incoming stream, comprising said feedstock as a mixture with at least a part of said liquid effluent resulting from stage c) and a hydrogen-rich gas, is of between 14° and 400° C., preferably between 22° and 350° C. and particularly preferably between 26° and 330° C.

In the case where at least a part of the liquid effluent resulting from the separation stage c) is preheated before being recycled upstream of the hydrogenation stage a), said effluent optionally passes through at least one exchanger and/or at least one oven before being recycled upstream of the hydrogenation stage a), so as to adjust the temperature of said recycled liquid effluent.

In the case where at least a part of the liquid effluent resulting from the separation stage c) is cooled before being recycled upstream of the hydrogenation stage a), said effluent optionally passes through at least one exchanger and/or at least one cooling tower before being recycled upstream of the hydrogenation stage a), so as to adjust the temperature of said recycled liquid effluent.

The use of the recycle upstream of the hydrogenation stage a) of at least a part of the liquid effluent resulting from stage c), which can be either cooled or preheated, if necessary, or kept at the same temperature as at the outlet of the separation stage c), thus makes it possible to adjust the temperature of the stream entering stage a), as needed.

According to an alternative form, the feedstock, before being mixed with at least a part of the effluent resulting from stage c), can be preheated by direct heating to a temperature ranging up to 200° C., preferably up to 180° C. and particularly preferably up to 150° C. Above this temperature, contact with a wall during the direct heating can bring about the formation of gums and/or of coke, which can cause fouling and an increase in the pressure drop of the system for heating the feedstock and also of the bed(s) of catalysts. The heating of the feedstock to a temperature above 150° C., preferably above 180° C. and particularly preferably above 200° C. is preferably carried out by indirect heating by at least a part of the effluent resulting from stage c).

Thus, the rise in temperature above 150° C., preferably above 180° C. and particularly preferably above 200° C. of the feedstock is brought about by mixing with a hotter liquid and not by contact with a heated wall. This makes it possible to locally limit the high temperatures. This is because, during heating in a heat exchanger or in an oven, in order to reach a given set temperature T, the temperature on the hot side necessarily has to be greater than T in order to carry out the heat transfer economically. It is well known to a person skilled in the art that the heat flux through a wall depends first on the temperature difference on both sides of said wall and on the exchange surface area. A small temperature difference between the cold side and the hot side would involve, for a given amount of heat exchanged, a greater exchange surface area. This results in a temperature of the wall in contact with the cold fluid which is higher than the desired temperature, commonly known as skin temperature. Heating by mixing with a hot fluid thus makes it possible to prevent the skin temperature effect and thus to limit the high temperature zones. This type of heating by mixing with an inert hot liquid thus makes it possible to limit the undesirable reactions, such as the polymerization of the diolefins (formation of gum) and/or the formation of coke, and to adjust the inlet temperature of the stream in stage a), so as to initiate the reaction of hydrogenation of the unsaturations, preferably at a temperature which is as low as possible, while controlling the exothermicity of these reactions by an effect of dilution of the reactive entities.

According to another alternative form, the feedstock is entirely heated by indirect heating by at least a part of the effluent resulting from stage c). In this case, the feedstock is not preheated before being mixed with at least a part of the effluent resulting from stage c).

The energy necessary for the reaction and more specifically the adjustment of the minimum temperature necessary for the activation of the reactions for saturation of the double bonds is thus mainly reached by mixing, upstream of stage a), said feedstock comprising a plastics pyrolysis oil and a hydrogen-rich gas, with a recycling of a portion of the liquid effluent resulting from the separation stage c), having optionally been subjected to an adjustment in temperature and preferably having been either preheated or cooled and particularly preferably having been preheated.

Another heating stream advantageously consists of a hydrogen-rich gaseous effluent originating from the hydrogen supply and/or of the gaseous effluent resulting from the separation stage d). At least a part of this hydrogen-rich gaseous effluent originating from the hydrogen supply and/or of the gaseous effluent resulting from the separation stage d) is advantageously injected as a mixture with at least a part of the liquid effluent resulting from stage c) or separately, upstream of stage a). The hydrogen-rich gas stream can thus be advantageously either preheated as a mixture with at least a part of the liquid effluent or preheated separately before mixing, preferably by optional passage through at least one exchanger and/or at least one oven or any other heating means known to a person skilled in the art.

Separation Stage d)

According to the invention, the treatment process comprises a separation stage d), advantageously carried out in at least one washing/separation section, fed with the first gaseous effluent and another part of the liquid effluent resulting from stage c) and an aqueous solution, said stage being carried out at a temperature of between 20 and less than 200° C. and at a pressure substantially identical to or less than the pressure of stage c), in order to obtain at least a second gaseous effluent, an aqueous effluent and a hydrocarbon effluent.

The separation stage d) is carried out in at least one knockout drum said to be a high-pressure or medium-pressure low-temperature knockout drum, also known to a person skilled in the art under the name CHPS (Cold High Pressure Separator). Thus, this stage d) preferably employs a "cold high-pressure" separator, the pressure being substantially equal to the operating pressure of stage c). The term "pressure substantially equal to the pressure of stage c)" is understood to mean the pressure of stage c) with a pressure difference of between 0 and 1 MPa, preferably of between 0.005 and 0.3 MPa and particularly preferably of between 0.01 and 0.2 MPa, with respect to the pressure of stage c). Preferably, the pressure of stage d) is the pressure of stage c) decreased by pressure drops. The fact of operating at least a part of the separation stage d) at a pressure substantially identical to the operating pressure of stage c) furthermore facilities the recycling of hydrogen.

The separation stage d) can also be carried out at a lower pressure than the pressure of stage c).

The separation stage d) can also comprise a (first) stage of separation at a pressure substantially equal to the operating pressure of stage c), followed by at least one other separation stage carried out at a temperature identical to or lower than and at a pressure lower than each preceding separation stage of stage d).

The temperature at which the separation of stage d) is carried out is of between 20 and less than 200° C., preferably of between 25 and 120° C. and particularly preferably of between 3° and 70° C.

It is important to operate in this temperature range (and thus to not excessively cool the hydroconverted effluent) at the risk of plugging in the lines due to the precipitation of the ammonium chloride salts.

The washing/separation section of stage d) can at least partly be carried out in common or separate items of washing and separation equipment, these items of equipment being well known (knockout drums which can be operated at various pressures and temperatures, pumps, heat exchangers, washing columns, and the like). The separation stage d) can, for example, comprise a column for stripping sour water (also known as sour water stripper) from the withdrawn aqueous fraction, a column for washing sour gases in order to purify the hydrogen-rich gas before recycling, a column for stabilization of the washed liquid effluent in order to remove the dissolved gases.

When one (or two) hydrocracking stages are present (described below), this stage d) can in addition be fed with at least a part of the hydrocracked effluent resulting from an optional hydrocracking stage.

The gaseous effluent obtained on conclusion of stage d) advantageously comprises hydrogen, preferably comprises at least 80 vol %, preferably at least 85 vol %, of hydrogen. Advantageously, said gaseous effluent can at least partly be recycled to the hydrogenation stage a) and/or the hydrotreating stage b) and/or to a or the hydrocracking stages f) when they are present, it being possible for the recycling system to comprise a purification section.

The gaseous effluent can also form the subject of additional separation(s) for the purpose of recovering at least one hydrogen-rich gas and/or light hydrocarbons, in particular ethane, propane and butane, which can advantageously be sent separately or as a mixture to one or more furnaces of the steam cracking stage g) so as to increase the overall yield of olefins.

The aqueous effluent obtained on conclusion of stage d) advantageously comprises ammonium salts and/or hydrochloric acid.

This separation stage d) makes it possible in particular to remove the ammonium chloride salts, which are formed by reaction between the chloride ions, released by the hydrogenation of the chlorinated compounds in HCl form, in particular during stages a) and b), followed by dissolution in the water, and the ammonium ions, generated by the hydrogenation of the nitrogenous compounds in $NH_3$ form, in particular during stage b), and/or introduced by injection of an amine, followed by dissolution in the water, and thus to limit the risks of plugging, in particular in the transfer lines and/or in the sections of the process of the invention and/or the lines for transfer to the steam cracker, due to the precipitation of the ammonium chloride salts. It also makes it possible to remove the hydrochloric acid formed by the reaction of the hydrogen ions and the chloride ions.

Depending on the content of chlorinated compounds in the initial feedstock to be treated, a stream containing an amine, such as, for example, monoethanolamine, diethanolamine and/or monodiethanolamine, can be injected upstream of each catalytic stage, preferably upstream of the hydrogenation stage a) and/or of the hydrotreating stage b), preferably upstream of the hydrogenation stage a), in order to ensure a sufficient amount of ammonium ions to combine with the chloride ions formed during the hydrotreating stage, thus making it possible to limit the formation of hydrochloric acid and thus to limit the corrosion downstream of the separation section.

Advantageously, the separation stage d) comprises an injection of an aqueous solution, preferably an injection of water, into the mixture of the gaseous effluent and of another part of the liquid effluent resulting from stage c), upstream of the washing/separation section, so as to dissolve, at least partly, ammonium chloride salts and/or hydrochloric acid and to thus improve the removal of the chlorinated impurities and to reduce the risks of pluggings due to an accumulation of the ammonium chloride salts.

In an optional embodiment of the invention, the separation stage d) comprises the injection of an aqueous solution into the mixture of the gaseous effluent and of another part of the liquid effluent resulting from stage c), followed by the washing/separation section advantageously comprising a phase of separation which makes it possible to obtain at least one aqueous effluent charged with ammonium salts, a washed liquid hydrocarbon effluent and a partially washed gaseous effluent. The aqueous effluent charged with ammonium salts and the washed liquid hydrocarbon effluent can subsequently be separated in a knockout drum in order to obtain said hydrocarbon effluent and said aqueous effluent. Said partially washed gaseous effluent can, in parallel, be introduced into a washing column where it circulates countercurrentwise to an aqueous stream, preferably of the same nature as the aqueous solution injected into the hydrotreated effluent, which makes it possible to remove, at least partly and preferably completely, the hydrochloric acid contained in the partially washed gaseous effluent and thus to obtain said gaseous effluent, preferably essentially comprising hydrogen, and an acidic aqueous stream. Said aqueous effluent resulting from the knockout drum can optionally be mixed with said acidic aqueous stream, and be used, optionally as a mixture with said acidic aqueous stream, in a water recycling circuit for feeding the separation stage d) with said aqueous solution upstream of the washing/separation section and/or with said aqueous stream in the washing column. Said water recycling circuit can comprise a supply of water and/or of a basic solution and/or a bleed making it possible to discharge the dissolved salts.

The hydrocarbon effluent resulting from the separation stage d) is sent, partly or completely, either directly to the inlet of a steam cracking unit or to an optional fractionation stage e). Preferably, the liquid hydrocarbon effluent is sent, partly or completely, preferably completely, to a fractionation stage e).

Fractionation Stage e) (Optional)

The process according to the invention can comprise a stage of fractionation of all or part, preferably of the whole, of the hydrocarbon effluent resulting from stage d), in order to obtain at least a third gas stream and at least two liquid hydrocarbon streams, said two liquid hydrocarbon streams being at least a first hydrocarbon cut comprising compounds having a boiling point of less than or equal to 175° C. (naphtha cut), in particular between 8° and 175° C., and a second hydrocarbon cut comprising compounds having a boiling point of greater than 175° C. (middle distillates cut).

Stage e) makes it possible in particular to remove the gases dissolved in the liquid hydrocarbon effluent, such as, for example, ammonia, hydrogen sulfide and light hydrocarbons having from 1 to 4 carbon atoms.

The optional fractionation stage e) is advantageously carried out at a pressure of less than or equal to 1.0 MPa abs., preferably between 0.1 and 1.0 MPa abs.

According to one embodiment, stage e) can be carried out in a section advantageously comprising at least one stripping column equipped with a reflux circuit comprising a reflux drum. Said stripping column is fed with the liquid hydrocarbon effluent resulting from stage d) and with a stream of steam. The liquid hydrocarbon effluent resulting from stage d) can optionally be heated before entering the stripping column. Thus, the lightest compounds are entrained in the column top and into the reflux circuit comprising a reflux drum in which a gas/liquid separation is carried out. The gas phase which comprises the light hydrocarbons is withdrawn from the reflux drum as a gas stream. The hydrocarbon cut comprising compounds having a boiling point of less than or equal to 175° C. is advantageously withdrawn from the reflux drum. The hydrocarbon cut comprising compounds having a boiling point of greater than 175° C. is advantageously withdrawn at the bottom of the stripping column.

According to other embodiments, the fractionation stage e) can employ a stripping column followed by a distillation column or only a distillation column.

The first hydrocarbon cut comprising compounds having a boiling point of less than or equal to 175° C. and the second hydrocarbon cut comprising compounds having a boiling point of greater than 175° C., which are optionally mixed, can be sent, completely or partly, to a steam cracking unit, at the outlet of which olefins may be (re)formed to participate in the formation of polymers. Preferably, only a part of said cuts is sent to a steam cracking unit; at least a fraction of the remaining part is optionally recycled in at least one of the stages of the process and/or sent to a fuel storage unit, for example a unit for storage of naphtha, a unit for storage of diesel or a unit for storage of kerosene, resulting from conventional petroleum feedstocks.

According to a preferred embodiment, the first hydrocarbon cut comprising compounds having a boiling point of less than or equal to 175° C. is sent, completely or partly, to a steam cracking unit, whereas the second hydrocarbon cut comprising compounds having a boiling point of greater than 175° C. is sent to a hydrocracking stage and/or sent to a fuel storage unit.

In a specific embodiment, the optional fractionation stage e) can make it possible to obtain, besides a gas stream, a naphtha cut comprising compounds having a boiling point of less than or equal to 175° C., preferably between 8° and 175° C., a middle distillates cut comprising compounds having a boiling point of greater than 175° C. and less than 385° C. and a hydrocarbon cut comprising compounds having a boiling point of greater than or equal to 385° C., known as heavy hydrocarbon cut. The naphtha cut can be sent, completely or partly, to a steam cracking unit and/or to the unit for storage of naphtha resulting from conventional petroleum feedstocks; it can also be recycled; the middle distillates cut can also be, completely or partly, either sent to a steam cracking unit, or to a unit for storage of diesel resulting from conventional petroleum feedstocks, or also be recycled; the heavy cut can, for its part, be sent, at least partly, to a steam cracking unit or be sent to the hydrocracking stage, when it is present.

In another specific embodiment, the optional fractionation stage e) can make it possible to obtain, besides a gas stream, a naphtha cut comprising compounds having a boiling point of less than or equal to 175° C., preferably between 8° and 175° C., a kerosene cut comprising compounds having a boiling point of greater than 175° C. and less than or equal to 280° C., a diesel cut comprising compounds having a boiling point of greater than 280° C. and less than 385° C. and a hydrocarbon cut comprising compounds having a boiling point of greater than or equal to 385° C., referred to as heavy hydrocarbon cut. The naphtha cut, the kerosene cut and/or the diesel cut can be, completely or partly, either sent to a steam cracking unit, or respectively to a naphtha, kerosene or diesel pool resulting from conventional petroleum feedstocks, or be recycled. The heavy cut can, for its part, be sent, at least partly, to a steam cracking unit or be sent to the hydrocracking stage, when it is present.

In another specific embodiment, the naphtha cut comprising compounds having a boiling point of less than or equal to 175° C. resulting from stage e) is fractionated to give a heavy naphtha cut comprising compounds having a boiling point between 8° and 175° C. and a light naphtha cut comprising compounds having a boiling point of less than 80° C., at least a part of said heavy naphtha cut being sent to an aromatic complex comprising at least one stage of reforming of the naphtha for the purpose of producing aromatic compounds. According to this embodiment, at least a part of the light naphtha cut is sent to the steam cracking stage g) described below.

The gas fraction(s) resulting from the fractionation stage d) can form the subject of additional purification(s) and separation(s) for the purpose of recovering at least light hydrocarbons, in particular ethane, propane and butane, which can advantageously be sent, separately or as a mixture, to one or more furnaces of the steam cracking stage g) so as to increase the overall yield of olefins.

Hydrocracking Stage f) (Optional)

According to an alternative form, the process of the invention can comprise a hydrocracking stage f) carried out after the separation stage d) with at least a part of said hydrocarbon effluent resulting from stage d) or carried out after the fractionation stage e) with at least a part of the second hydrocarbon cut comprising compounds having a boiling point of greater than 175° C.

Advantageously, stage f) employs hydrocracking reactions well known to a person skilled in the art, and more particularly makes it possible to convert the heavy compounds, for example compounds having a boiling point of greater than 175° C., into compounds having a boiling point of less than or equal to 175° C., contained in the hydrocarbon effluent resulting from the fractionation stage e). Other reactions, such as the hydrogenation of olefins or aromatics, hydrodemetallization, hydrodesulfurization, hydrodenitrogenation, and the like, can be pursued.

The compounds having a boiling point of greater than 175° C. have a high BMCI and contain, with respect to lighter compounds, more naphthenic, naphthenic-aromatic and aromatic compounds, thus leading to a higher C/H ratio. This high ratio is a cause of coking in the steam cracker, thus requiring steam cracking furnaces dedicated to this cut. When it is desired to minimize the yield of these heavy compounds (middle distillates cut) and to maximize the yield of light compounds (naphtha cut), these compounds can be at least partly converted into light compounds by hydrocracking, a cut generally favoured for a steam cracking unit.

Thus, the process of the invention can comprise a hydrocracking stage f) carried out in a hydrocracking reaction section, employing at least one fixed-bed reactor having n catalytic beds, n being an integer greater than or equal to 1, each comprising at least one hydrocracking catalyst, said hydrocracking reaction section being fed with at least a part of said hydrocarbon effluent resulting from stage d) and/or with at least at part of the second hydrocarbon cut comprising compounds having a boiling point of greater than 175° C. resulting from stage e) and a third gas stream comprising hydrogen, said hydrocracking reaction section being employed at an average temperature between 25° and 450° C., a partial hydrogen pressure between 1.5 and 20.0 MPa abs. and an hourly space velocity between 0.1 and 10.0 $h^{-1}$, in order to obtain a first hydrocracked effluent.

Thus, said hydrocracking reaction section is advantageously employed at an average temperature between 25° and 480° C., preferably between 32° and 450° C., at a hydrogen partial pressure between 1.5 and 20.0 MPa abs., preferably between 3 and 18.0 MPa abs., and at an hourly space velocity (HSV) between 0.1 and 10.0 $h^{-1}$, preferably between 0.1 and 5.0 $h^{-1}$, preferentially between 0.2 and 4 $h^{-1}$. The hydrogen coverage in stage c) is advantageously of between 80 and 2000 $Sm^3$ of hydrogen per $m^3$ of fresh feedstock which feeds stage a) and preferably between 200 and 1800 $Sm^3$ of hydrogen per $m^3$ of fresh feedstock which feeds stage a). The definitions of the average temperature (WABT), of the HSV and of the hydrogen coverage correspond to those described above.

Advantageously, said hydrocracking reaction section is employed at a pressure equivalent to that used in the reaction section of the hydrogenation stage a) or of the hydrotreating stage b).

Advantageously, said stage f) is carried out in a hydrocracking reaction section comprising at least one, preferably between one and five, fixed-bed reactor(s) having n catalytic beds, n being an integer greater than or equal to one, preferably of between one and ten, in a preferred way of between two and five, said bed(s) each comprising at least one, and preferably not more than ten, hydrocracking catalyst(s). When a reactor comprises several catalytic beds, that is to say at least two, preferably between two and ten, in a preferred way between two and five, catalytic beds, said catalytic beds are preferably arranged in series in said reactor.

The hydrocracked effluent can, at least partly, be recycled in the hydrogenation stage a) and/or in the hydrotreating stage b) and/or in the separation stage d). Preferably, it is recycled in the separation stage d).

The hydrocracking stage can be carried out in one stage (stage f)) or two stages (stages f) and f')). When it is carried out in two stages, a separation of the effluent resulting from the first hydrocracking stage f) is carried out, making it possible to obtain a hydrocarbon cut comprising compounds having a boiling point of greater than 175° C. (middle distillates cut), which cut is introduced into the second hydrocracking stage f') comprising a dedicated second hydrocracking reaction section different from the first hydrocracking reaction section f). This configuration is particularly suitable when it is desired to produce only a naphtha cut.

The second hydrocracking stage f') est carried out in a hydrocracking reaction section, employing at least one fixed-bed reactor having n catalytic beds, n being an integer greater than or equal to 1, each comprising at least one hydrocracking catalyst, said hydrocracking reaction section being fed with at least a part of the first hydrocracked effluent resulting from the first hydrocracking stage f) and a gas stream comprising hydrogen, said hydrocracking reaction section being employed at an average temperature between 25° and 450° C., a partial hydrogen pressure between 1.5 and 20.0 MPa abs. and an hourly space velocity between 0.1 and 10.0 $h^{-1}$, in order to obtain a second hydrocracked effluent. The preferred operating conditions and the catalysts used in the second hydrocracking stage are those described for the first hydrocracking stage. The operating conditions and catalysts used in the two hydrocracking stages can be identical or different.

Said second hydrocracking stage is preferably carried out in a hydrocracking reaction section comprising at least one, preferably between one and five, fixed-bed reactor(s) having n catalytic beds, n being an integer greater than or equal to one, preferably of between one and ten, in a preferred way of between two and five, said bed(s) each comprising at least one, and preferably not more than ten, hydrocracking catalyst(s).

These operating conditions used in the hydrocracking stage(s) generally make it possible to obtain conversions per pass, into products having at least 80% by volume of compounds having boiling points of less than or equal to 175° C., preferably of less than 160° C. and in a preferred way of less than 150° C., of greater than 15% by weight and more preferably still of between 20% and 95% by weight. When the process is carried out in two hydrocracking stages, the conversion per pass in the second stage is kept moderate in order to maximize the selectivity for compounds of the naphtha cut (having a boiling point of less than or equal to 175° C., in particular between 80 and less than or equal to 175° C.). The conversion per pass is limited by the use of a high recycle rate over the loop of the second hydrocracking stage. This rate is defined as the ratio of the feed flow rate of stage f') to the flow rate of the feedstock of stage a); preferentially, this ratio is of between 0.2 and 4, preferably between 0.5 and 2.5.

The hydrocracked effluent of the second hydrocracking stage f') can, at least partly, be recycled in the hydrogenation stage a) and/or in the hydrotreating stage b) and/or in the separation stage d). Preferably, it is recycled in the separation stage d).

The hydrocracking stage(s) thus does (do) not necessarily make it possible to convert all the hydrocarbon compounds having a boiling point of greater than 175° C. (middle distillates cut) into hydrocarbon compounds having a boiling point of less than or equal to 175° C. (naphtha cut). After the fractionation stage e), there may thus remain a more or less significant proportion of compounds having a boiling point of greater than 175° C. In order to increase the conversion, at least a part of this unconverted cut can be introduced into a second hydrocracking stage f'). Another part can be bled off. Depending on the operating conditions of the process, said bleed can be of between 0% and 10% by weight of the cut comprising compounds having a boiling point of greater than 175° C., with respect to the incoming feedstock, and preferably between 0.5% and 5% by weight.

In accordance with the invention, the hydrocracking stage(s) proceed(s) in the presence of at least one hydrocracking catalyst.

The hydrocracking catalyst(s) used in the hydrocracking stage(s) are conventional hydrocracking catalysts known to a person skilled in the art, of bifunctional type combining an acid function with a hydro-dehydrogenating function and optionally at least one binding matrix. The acid function is contributed by supports of high specific surface area (generally 150 to 800 $m^2/g$) exhibiting a surface acidity, such as halogenated (in particular chlorinated or fluorinated) aluminas, combinations of aluminium and boron oxides, amorphous silica-aluminas and zeolites. The hydro-dehydrogenating function is contributed by at least one metal from group VIB of the Periodic Table and/or at least one metal from group VIII.

Preferably, the hydrocracking catalyst(s) comprise a hydro-dehydrogenating function comprising at least one metal from group VIII chosen from iron, cobalt, nickel, ruthenium, rhodium, palladium and platinum, and preferably from cobalt and nickel. Preferably, said catalyst(s) also comprise at least one metal from group VIB chosen from chromium, molybdenum and tungsten, alone or as a mixture, and preferably from molybdenum and tungsten. Hydro-dehydrogenating functions of NiMo, NiMoW or NiW type are preferred.

Preferably, the content of metal from group VIII in the hydrocracking catalyst(s) is advantageously of between 0.5% and 15% by weight and preferably between 1% and 10% by weight, the percentages being expressed as percentage by weight of oxides, with respect to the total weight of the catalyst. When the metal is cobalt or nickel, the metal content is expressed as CoO and NiO respectively.

Preferably, the content of metal from group VIB in the hydrocracking catalyst(s) is advantageously of between 5% and 35% by weight and preferably between 10% and 30% by weight, the percentages being expressed as percentage by weight of oxides, with respect to the total weight of the catalyst. When the metal is molybdenum or tungsten, the metal content is expressed as $MoO_3$ and $WO_3$ respectively.

The hydrocracking catalyst(s) can also optionally comprise at least one promoter element deposited on the catalyst and chosen from the group formed by phosphorus, boron and silicon, optionally at least one element from group VIIa (chlorine, fluorine preferred), optionally at least one element from group VIIB (manganese preferred) and optionally at least one element from group VB (niobium preferred).

Preferably, the hydrocracking catalyst(s) comprise at least one amorphous or poorly crystalline porous inorganic matrix of oxide type chosen from aluminas, silicas, silica-aluminas, aluminates, alumina-boron oxide, magnesia, silica-magnesia, zirconia, titanium oxide or clay, alone or as a mixture, and preferably aluminas or silica-aluminas, alone or as a mixture.

Preferably, the silica-alumina contains more than 50% by weight of alumina, preferably more than 60% by weight of alumina.

Preferably, the hydrocracking catalyst(s) also optionally comprise a zeolite chosen from Y zeolites, preferably from USY zeolites, alone or in combination with other zeolites from beta, ZSM-12, IZM-2, ZSM-22, ZSM-23, SAPO-11, ZSM-48 or ZBM-30 zeolites, alone or as a mixture. Preferably, the zeolite is USY zeolite alone.

In the case where said catalyst comprises a zeolite, the content of zeolite in the hydrocracking catalyst(s) is advantageously of between 0.1% and 80% by weight, preferably of between 3% and 70% by weight, the percentages being expressed as percentage of zeolite with respect to the total weight of the catalyst.

A preferred catalyst comprises, and preferably consists of, at least one metal from group VIB and optionally at least one non-noble metal from group VIII, at least one promoter element, and preferably phosphorus, at least one Y zeolite and at least one alumina binder.

An even more preferred catalyst comprises, and preferably consists of, nickel, molybdenum, phosphorus, a USY zeolite, and optionally also a beta zeolite, and alumina.

Another preferred catalyst comprises, and preferably consists of, nickel, tungsten, alumina and silica-alumina.

Another preferred catalyst comprises, and preferably consists of, nickel, tungsten, a USY zeolite, alumina and silica-alumina.

Said hydrocracking catalyst is, for example, in the form of extrudates.

In an alternative form, the hydrocracking catalyst employed in the second hydrocracking stage comprises a hydro-dehydrogenating function comprising at least one noble metal from group VIII chosen from palladium and platinum, alone or as a mixture. The content of noble metal from group VIII is advantageously of between 0.01% and 5% by weight and preferably between 0.05% and 3% by weight, the percentages being expressed as percentage by weight of oxides (PtO or PdO), with respect to the total weight of the catalyst.

According to another aspect of the invention, the hydrocracking catalyst additionally comprises one or more organic compounds containing oxygen and/or nitrogen and/or sulfur. Such a catalyst is often denoted by the term "additivated catalyst". Generally, the organic compound is chosen from a compound comprising one or more chemical functions chosen from a carboxyl, alcohol, thiol, thioether, sulfone, sulfoxide, ether, aldehyde, ketone, ester, carbonate, amine, nitrile, imide, oxime, urea and amide function or also compounds including a furan ring or also sugars.

The preparation of the catalysts of the hydrogenation, hydrotreating and hydrocracking stages is known and generally comprises a stage of impregnation of the metals from group VIII and from group VIB, when it is present, and optionally of the phosphorus and/or of the boron on the support, followed by drying, and then optionally by a calcination. In the case of additivated catalyst, the preparation generally takes place by simple drying without calcination after introduction of the organic compound. The term "calcination" is understood here to mean a heat treatment under a gas containing air or oxygen at a temperature of greater than or equal to 200° C. Before their use in a stage of the process, the catalysts are generally subjected to a sulfidation in order to form the active entity. The catalyst of stage a) can also be a catalyst used in its reduced form, thus involving a reduction stage in its preparation.

The gas stream comprising hydrogen, which feeds the hydrogenation, hydrotreating and hydrocracking reaction section, can consist of a supply of hydrogen and/or can consist of recycled hydrogen resulting in particular from the separation stage d). Preferably, an additional gas stream comprising hydrogen is advantageously introduced at the inlet of each reactor, in particular operating in series, and/or at the inlet of each catalytic bed starting from the second catalytic bed of the reaction section. These additional gas streams are also referred to as cooling streams. They make it possible to control the temperature in the reactor in which the reactions carried out are generally highly exothermic.

Said hydrocarbon effluent or said hydrocarbon stream(s) thus obtained by treatment according to the process of the invention of a plastics pyrolysis oil exhibit(s) a composition compatible with the specifications of a feedstock at the inlet of a steam cracking unit. In particular, the composition of the hydrocarbon effluent or of said hydrocarbon stream(s) is preferably such that:

- the total content of metal elements is less than or equal to 10.0 ppm by weight, preferably less than or equal to 2.0 ppm by weight, preferentially less than or equal to 1.0 ppm by weight and in a preferred way less than or equal to 0.5 ppm by weight, with:

a content of silicon (Si) element of less than or equal to 5.0 ppm by weight, preferably of less than or equal to 1 ppm by weight and in a preferred way of less than or equal to 0.6 ppm by weight and/or a content of iron (Fe) element of less than or equal to 200 ppb by weight,

- the sulfur content is less than or equal to 500 ppm by weight, preferably less than or equal to 200 ppm by weight, and/or
- the nitrogen content is less than or equal to 100 ppm by weight, preferably less than or equal to 50 ppm by weight and in a preferred way less than or equal to 5 ppm by weight, and/or
- the content of asphaltenes is less than or equal to 5.0 ppm by weight, and/or
- the total content of chlorine element is less than or equal to 10 ppm by weight, preferably less than 1.0 ppm by weight, and/or
- the mercury content is less than or equal to 5 ppb by weight, preferably less than 3 ppb by weight, and/or
- the content of olefinic compounds (monoolefins and diolefins) is less than or equal to 5.0% by weight, preferably less than or equal to 2.0% by weight and in a preferred way less than or equal to 0.1% by weight.

The contents are given as relative concentrations by weight, percentages (%) by weight, part(s) per million (ppm) by weight or part(s) per billion (ppb) by weight, with respect to the total weight of the stream under consideration.

The process according to the invention thus makes it possible to treat plastics pyrolysis oils in order to obtain an effluent which can be injected, completely or partly, into a steam cracking unit.

Stage (Optional) of Adsorption of Heavy Metals

Any gaseous effluent and/or any liquid effluent resulting from at least one of the separation stages c) and d) or from the fractionation stage e) can be subjected to an optional stage of adsorption of heavy metals.

The gaseous effluents can in particular be the first gaseous effluent resulting from stage c) and/or the second gaseous effluent resulting from stage d) and/or the third gaseous effluent resulting from stage e).

The liquid effluents can in particular be the liquid effluent resulting from stage c) and/or the hydrocarbon effluent resulting from stage d) and/or the first and/or the second hydrocarbon cut resulting from stage e).

The optional adsorption stage makes it possible to eliminate or reduce the amount of metal impurities, in particular the amount of heavy metals, such as arsenic, zinc, lead and in particular mercury, possibly present in said gaseous and liquid effluents. The metal impurities, and in particular the heavy metals, are present in the feedstock. Some impurities, in particular based on mercury, can be transformed in one of the stages of the process according to the invention. Their transformed form is easier to trap. Their elimination or reduction may in particular be necessary when a part at least of said gaseous and liquid effluents is intended to be sent, either directly or after having been subjected to one or more optional additional stages, such as the fractionation stage e), to a stage having strict specifications for metal impurities, such as a steam cracking stage.

Thus, an optional stage of adsorption of a gaseous effluent resulting from stages c), d) and/or e) and/or of the liquid effluent resulting from stage c) and/or of the hydrocarbon effluent resulting from stage d) and/or of the first and/or the second hydrocarbon cut resulting from stage e) is advantageously carried out in particular when at least one of these effluents or the feedstock respectively comprise more than 20 ppb by weight, in particular more than 15 ppb by weight, of metal elements of heavy metals (As, Zn, Pb, Hg, and the like), and in particular when at least one of these effluents or the feedstock respectively comprise more than 10 ppb by weight of mercury, more particularly more than 15 ppb by weight of mercury.

Said optional adsorption stage is advantageously carried out at a temperature between 2° and 150° C., preferably between 4° and 100° C., and at a pressure between 0.15 and 10.0 MPa abs., preferably between 0.2 and 1.0 MPa abs.

Said optional adsorption stage can be carried out by any adsorbent known to a person skilled in the art which makes it possible to reduce the amount of such contaminants.

According to an alternative form, said optional adsorption stage is carried out in an adsorption section operated in the presence of at least one adsorbant comprising a porous support and at least one active phase which can be based on sulfur in the elemental form, or in the metal sulfide or metal oxide form, or also in the metal form in elemental form.

The porous support can be chosen without distinction from the families of the aluminas, silica-aluminas, silicas, zeolites or active carbons. Advantageously, the porous support is based on alumina. The specific surface of the support is generally of between 150 and 600 $m^2/g$, preferably between 200 and 400 $m^2/g$, more preferably still between 150 and 350 $m^2/g$. The specific surface of the adsorbent is a surface measured by the BET method, as described above.

The active phase is based on sulfur in the elemental form, or in the metal sulfide or metal oxide form, or also in the metal form in elemental form. Preferably, the active phase is in the metal sulfide form, in particular a sulfide of a metal from the group chosen from copper, molybdenum, tungsten, iron, nickel or cobalt.

Advantageously, the active phase of the adsorbent comprises between 1% and 70% by weight of sulfur, with respect to the total weight of the adsorbent, preferably between 2% and 25% and very preferably between 3% and 20%.

Advantageously, the proportion by weight of metal, with respect to the total weight of the adsorbent, is generally of between 1% and 60%, preferably between 2% and 40%, in a preferred way between 5% and 30%, very preferably between 5% and 20%.

The residence time in the adsorption section is generally of between 1 and 180 minutes.

Said adsorption section can comprise one or more adsorption columns. When the adsorption section comprises two adsorption columns, one operating mode can be a "swing" operation, in which one of the columns is on-line, that is to say in operation, while the other column is in reserve.

Another operating mode is to have at least two columns operating in series in permutable mode.

Preferably, said adsorption section comprises an adsorption column for the gaseous effluent(s) and an adsorption column for the liquid effluent(s).

Steam Cracking Stage g) (Optional)

The hydrocarbon effluent resulting from the separation stage d), or at least one of the two liquid hydrocarbon streams resulting from the optional stage e), can be sent, completely or partly, to a steam cracking stage g).

Advantageously, the gas fraction(s) resulting from the separation stage d) and/or the fractionation stage e) and containing ethane, propane and butane can also be sent, completely or partly, to the steam cracking stage g).

Said steam cracking stage g) is advantageously carried out in at least one pyrolysis furnace at a temperature of between 70° and 900° C., preferably between 75° and 850° C., and at a pressure of between 0.05 and 0.3 MPa relative. The residence time of the hydrocarbon compounds is generally less than or equal to 1.0 second (denoted s), preferably of between 0.1 and 0.5 s. Advantageously, steam is introduced upstream of the optional steam cracking stage g) and after the separation (or the fractionation). The amount of water introduced, advantageously in the form of steam, is advantageously of between 0.3 and 3.0 kg of water per kg of hydrocarbon compounds at the inlet of stage e). Preferably, the optional stage g) is carried out in several pyrolysis furnaces in parallel, so as to adapt the operating conditions to the various streams feeding stage g), in particular resulting from stage e), and also to manage the decoking times of the tubes. A furnace comprises one or more tubes arranged in parallel. A furnace can also denote a group of furnaces operating in parallel. For example, a furnace may be dedicated to the cracking of the hydrocarbon cut comprising compounds having a boiling point of less than or equal to 175° C.

The effluents from the various steam cracking furnaces are generally recombined before separation for the purpose of constituting an effluent. It is understood that the steam cracking stage g) comprises the steam cracking furnaces but also the substages associated with the steam cracking which are well known to a person skilled in the art. These substages can in particular comprise heat exchangers, columns and catalytic reactors and recyclings to the furnaces. A column generally makes it possible to fractionate the effluent for the purpose of recovering at least one light fraction comprising hydrogen and compounds having from 2 to 5 carbon atoms, and a fraction comprising pyrolysis petrol, and optionally a fraction comprising pyrolysis oil. Columns make it possible to separate the various constituents of the fractionation light fraction in order to recover at least one cut rich in ethylene ($C_2$ cut) and one cut rich in propylene ($C_3$ cut) and optionally a cut rich in butenes ($C_4$ cut). The catalytic reactors make it possible in particular to carry out hydrogenations of the $C_2$, $C_3$, indeed even $C_4$, cuts and of the pyrolysis petrol. The saturated compounds, in particular the saturated compounds having from 2 to 4 carbon atoms, are advantageously recycled to the steam cracking furnaces so as to increase the overall yields of olefins.

This steam cracking stage g) makes it possible to obtain at least one effluent containing olefins comprising 2, 3 and/or 4 carbon atoms (that is to say $C_2$, $C_3$ and/or $C_4$ olefins), at satisfactory contents, in particular of greater than or equal to 30% by weight, in particular of greater than or equal to 40% by weight, indeed even of greater than or equal to 50% by weight, of total olefins comprising 2, 3 and 4 carbon atoms, with respect to the weight of the steam cracking effluent under consideration. Said $C_2$, $C_3$ and $C_4$ olefins can subsequently be advantageously used as polyolefin monomers.

According to a preferred embodiment of the invention, the process for the treatment of a feedstock comprising a plastics pyrolysis oil comprises, preferably consists of, the linking together of the following stages, and preferably in the order given:

- hydrogenation stage a), hydrotreating stage b), separation stage c) and separation/washing stage d),
- hydrogenation stage a), hydrotreating stage b), separation stage c) and separation/washing stage d) and fractionation stage e),
- hydrogenation stage a), hydrotreating stage b), separation stage c) and separation/washing stage d), fractionation stage e) and stage of introduction of the hydrocarbon cut comprising compounds having a boiling point of greater than 175° C. at the hydrocracking stage f), the hydrocracked effluent being recycled in stage d).

All the embodiments can comprise and preferably consist of, in addition, a pretreatment stage a0).

All the embodiments can comprise and preferably consist of, in addition, a steam cracking stage g).

All the embodiments comprise the recycling, in stage a), of at least a part of a liquid effluent resulting from a separation stage c).

Analysis Methods Used

The analysis methods and/or standards used to determine the characteristics of the various streams, in particular of the feedstock to be treated and of the effluents, are known to a person skilled in the art. They are in particular listed below by way of information. Other methods reputed to be equivalent can also be used, in particular equivalent IP, EN or ISO methods:

TABLE 1

| Description | Methods |
|---|---|
| Density @15° C. | ASTM D4052 |
| Sulfur Content | ISO 20846 |
| Nitrogen Content | ASTM D4629 |
| Acid number | ASTM D664 |
| Bromine Number | ASTM D1159 |
| Content of Diolefins from the maleic anhydride value | MAV method (1) |
| Content of Oxygen-containing molecules | Combustion + Infrared |
| Content of Paraffins | UOP990-11 |
| Content of Naphthenes and Olefins | UOP990-11 |
| Content of Aromatics | UOP990-11 |
| Content of Halogens | ASTM D7359 |
| Chloride Content | ASTM D7536 |
| Content of Metals: | ASTM D5185 |
| P | |
| Fe | |
| Si | |
| Na | |
| B | |
| Simulated distillation | ASTM D2887 |

(1) MAV method described in the paper: C. López-García et al., Near Infrared Monitoring of Low Conjugated Diolefins Content in Hydrotreated FCC Gasoline Streams, Oil & Gas Science and Technology - Rev. IFP, Vol. 62 (2007), No. 1, pp. 57-68

BRIEF DESCRIPTION OF THE FIGURES

The particulars of the elements referenced in FIGS. 1 to 2 makes possible a better understanding of the invention, without the latter being limited to the specific embodiments illustrated in FIGS. 1 to 2. The various embodiments presented can be used alone or in combination with one another, without limitation of combination.

Figure 1:
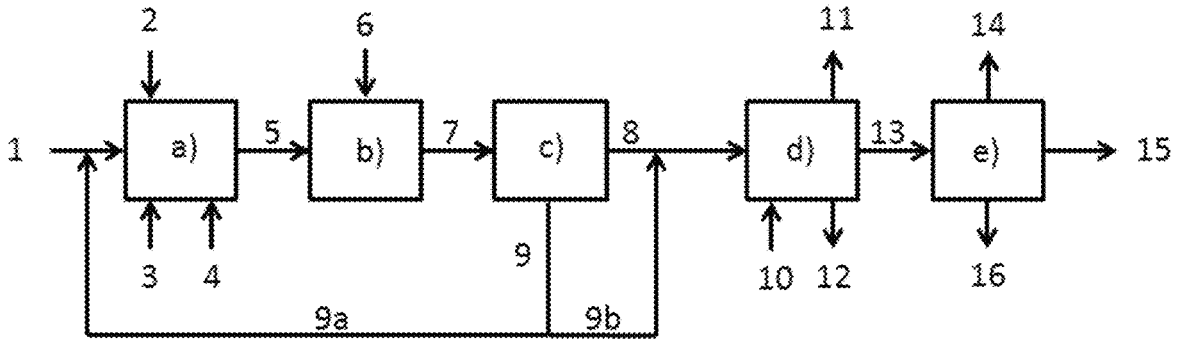
FIG. 1 represents the diagram of a specific embodiment of the process of the present invention, comprising.

- a stage a) of hydrogenation of a hydrocarbon feedstock resulting from the pyrolysis of plastics 1 as a mixture with at least a part of the recycled liquid effluent 9a resulting from stage c) and in the presence of a hydrogen-rich gas 2 and optionally of an amine contributed by the stream 3 and optionally of a sulfur compound contributed by the stream 4, carried out in at least one fixed-bed reactor comprising at least one hydrogenation catalyst, in order to obtain a hydrogenated effluent 5;
- a stage b) of hydrotreating the hydrogenated effluent 5 resulting from stage a), in the presence of hydrogen 6, carried out in at least one fixed-bed reactor comprising at least one hydrotreating catalyst, in order to obtain a hydrotreated effluent 7;
- a stage c) of separation of the hydrotreated effluent 7 carried out at high pressure and high temperature (HHPS), in order to obtain at least a first gaseous effluent 8 and a liquid effluent 9, a part 9a of which is recycled upstream of stage a),
- a separation stage d) carried out at high pressure and low temperature (CHPS) and fed by the first gaseous effluent 8 and the other part of the liquid effluent 9b resulting from stage c) and an aqueous solution 10, making it possible to obtain at least a second gaseous effluent 11 comprising hydrogen, an aqueous effluent 12 containing dissolved salts, and a hydrocarbon effluent 13;
- optionally a stage e) of fractionation of the hydrocarbon effluent 13 making it possible to obtain at least a third gaseous effluent 14, a first hydrocarbon cut 15 comprising compounds having a boiling point of less than or equal to 175° C. (naphtha cut) and a second hydrocarbon cut 16 comprising compounds having a boiling point of greater than 175° C. (middle distillates cut).

On conclusion of stage e), a part of the first hydrocarbon cut 15 comprising compounds having a boiling point of less than or equal to 175° C. can be sent to a steam cracking process (not represented). Another part of the first hydrocarbon cut 15 can feed the hydrogenation stage a) and/or the hydrotreating stage b) (not represented).

Figure 2:
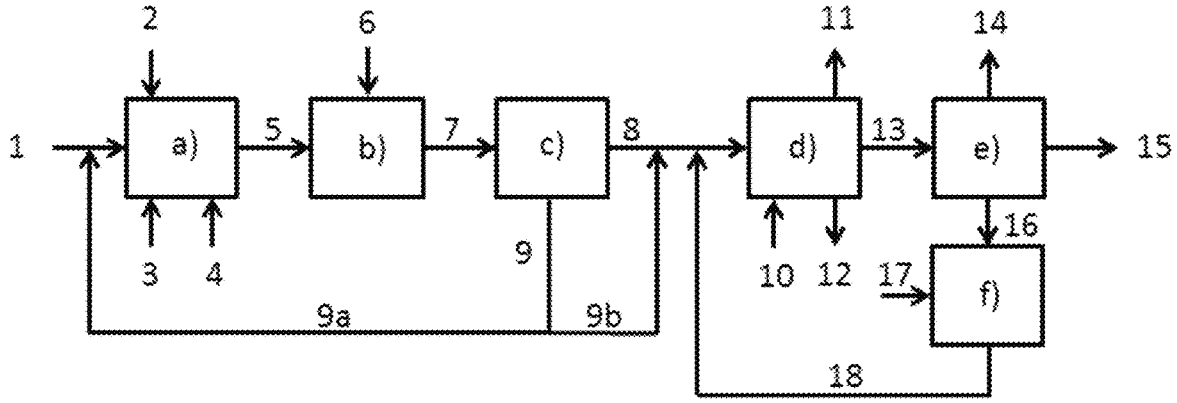

FIG. 2 represents the diagram of another specific embodiment of the process of the present invention which is based on the diagram of FIG. 1. This diagram comprises in particular a hydrocracking stage f) in which at least a part of the second hydrocarbon cut 16 comprising compounds having a boiling point of greater than 175° C. resulting from stage e) feeds this hydrocracking stage f), which is carried out in at least one fixed-bed reactor comprising at least one hydrocracking catalyst and is fed with hydrogen 17. The hydrocracked effluent 18 is recycled upstream of the separation stage d).

Instead of injecting the amine stream 3 at the inlet of the hydrogenation stage a), it is possible to inject it at the inlet of the hydrotreating stage b), at the inlet of the separation stage c), at the inlet of the hydrocracking stage f), when it is present, or else not to inject it, depending on the characteristics of the feedstock.

Only the main stages, with the main streams, are represented in FIGS. 1 and 2, in order to make it possible for the invention to be better understood. It is clearly understood that all the items of equipment required for the operation are present (drums, pumps, exchangers, ovens, columns, and the like), even if not represented. It is also understood that gas streams rich in hydrogen (supply or recycle), as described above, can be injected at the inlet of each reactor or catalytic bed or between two reactors or two catalytic beds. Means well known to a person skilled in the art for the purification and recycling of hydrogen can also be employed.

EXAMPLES

Example 1 (in Accordance with the Invention)

The feedstock 1 treated in the process is a plastics pyrolysis oil (that is to say, comprising 100% by weight of said plastics pyrolysis oil) exhibiting the characteristics indicated in Table 2.

TABLE 2

Characteristics of the feedstock

| Description | Methods | Unit | Pyrolysis oil |
|---|---|---|---|
| Density @15° C. | ASTM D4052 | g/cm$^3$ | 0.820 |
| Sulfur content | ISO 20846 | ppm by weight | 2500 |
| Nitrogen content | ASTM D4629 | ppm by weight | 730 |
| Acid number | ASTM D664 | mg KOH/g | 1.5 |
| Bromine content | ASTM D1159 | g/100 g | 80 |
| Content of Diolefins from the maleic anhydride value | MAV Method[1] | % by weight | 10 |
| Content of Oxygen-containing molecules | Combustion + Infrared | % by weight | 1.0 |
| Content of Paraffins | UOP990-11 | % by weight | 45 |
| Content of Naphthenes | UOP990-11 | % by weight | 20 |
| Content of Olefins | UOP990-11 | % by weight | 25 |
| Content of Aromatics | UOP990-11 | % by weight | 10 |
| Content of Halogens | ASTM D7359 | ppm by weight | 350 |
| Content of Asphaltenes | IFP9313 | ppm by weight | 380 |
| Chloride content | ASTM D7536 | ppm by weight | 320 |
| Content of Metals: | ASTM D5185 | | |
| P | | ppm by weight | 10 |
| Fe | | ppm by weight | 25 |
| Si | | ppm by weight | 45 |
| Na | | ppm by weight | 2 |
| B | | ppm by weight | 2 |
| Simulated Distillation: | ASTM D2887 | | |
| 0% | | ° C. | 40 |
| 10% | | ° C. | 98 |
| 30% | | ° C. | 161 |
| 50% | | ° C. | 232 |
| 70% | | ° C. | 309 |
| 90% | | ° C. | 394 |
| 100% | | ° C. | 432 |

[1]MAV method described in the paper: C. López-García et al., Near Infrared Monitoring of Low Conjugated Diolefins Content in Hydrotreated FCC Gasoline Streams, Oil & Gas Science and Technology - Rev. IFP, Vol. 62 (2007), No. 1, pp. 57-68

The feedstock 1 and a hydrogen-rich gas 2 are preheated beforehand to 100° C. by an oven. A part of the liquid effluent resulting from the separation stage c) carried out at 300° C. is preheated to 382° C. and constitutes a hot liquid recycle 9a. The feedstock 1, the hydrogen-rich gas and the hot liquid recycle are mixed and subjected to a hydrogenation stage a) carried out in a fixed-bed reactor and of a hydrogenation catalyst of NiMo-on-alumina type under the conditions indicated in Table 3.

For a flow rate of feedstock 1 of 6.25 T/h and a hot recycle flow rate of 18.75 T/h, the heat saved by virtue of the hot liquid recycle at 382° C., taking into account the excess heating from 300 to 382° C., and compared with a liquid recycle cooled to 40° C., is approximately 3.6 MW. This saved heat reduces the operating costs and the capital costs necessary for the process. For this reason, the products resulting from the process are obtained with a lower carbon footprint, that is to say that the gas emissions and greenhouse effects, and in particular carbon dioxide, are reduced. The heat contribution of the hot liquid recycle also makes it possible not to overheat the feedstock since it is heated indirectly by mixing; this makes it possible to limit the formation of gums and/or of coke at the inlet of the reactor, which would result, in the long run, in an increase in the pressure drop.

TABLE 3

| Conditions of the hydrogenation stage a) | | |
|---|---|---|
| Reactor inlet temperature | ° C. | 291 |
| Reactor outlet temperature | ° C. | 311 |
| Average temperature (WABT) | ° C. | 301 |
| Partial hydrogen pressure | MPa abs. | 6.2 |
| $H_2$/HC (Hydrogen coverage by volume, with respect to the volume of feedstock) | $Sm^3/m^3$ | 700 |
| HSV (flow rate by volume of feedstock/volume of catalysts) | $h^{-1}$ | 0.5 |
| Liquid recycle/feedstock (flow rate by weight liquid recycle from c) to a)/flow rate by weight of feedstock to a)) ratio | w/w | 3 |

The conditions indicated in Table 3 correspond to conditions at the beginning of the cycle and the average temperature (WABT) is increased by 1° C. per month so as to compensate for the catalytic deactivation.

On conclusion of the hydrogenation stage a), the degrees of conversion (=(initial concentration−final concentration)/initial concentration) observed are indicated in Table 4.

TABLE 4

| Conversions of the entities during the hydrogenation stage a) | | |
|---|---|---|
| Degree of conversion of the diolefins | % | >70 |
| Degree of conversion of the olefins | % | >70 |
| Retention of silicon | % | >85 |

The hydrogenated effluent 5 resulting from the hydrogenation stage a) is subjected directly, without separation, to a hydrotreating stage b) carried out in a fixed bed and in the presence of hydrogen 6 and of a hydrotreating catalyst of NiMo-on-alumina type under the conditions presented in Table 5.

TABLE 5

| Conditions of the hydrotreating stage b) | | |
|---|---|---|
| Hydrotreating average temperature (WABT) | ° C. | 303 |
| Partial hydrogen pressure | MPa abs. | 6.0 |
| $H_2$/HC (Hydrogen coverage by volume, with respect to the volume of feedstock) | $Sm^3/m^3$ | 700 |
| HSV (flow rate by volume of feedstock/volume of catalysts) | $h^{-1}$ | 0.5 |

The conditions indicated in Table 5 correspond to conditions at the beginning of the cycle and the average temperature (WABT) is increased by 1° C. per month so as to compensate for the catalytic deactivation.

The hydrotreated effluent 7 resulting from the hydrotreating stage b) is subjected to a separation stage c) at a pressure substantially identical to that of stage b) and the temperature of which is controlled at 300° C., making it possible to obtain a gaseous effluent and a liquid effluent, a part of which is heated to 382° C. and then recycled to the hydrogenation stage a), this recycled liquid part constituting a hot recycle 9a.

The first gaseous effluent resulting from c) 8 and the part of the liquid effluent resulting from c) 9b which is not recycled to stage a) are mixed and then subjected to a separation stage d): a stream of water 10 is injected into the mixture of the gaseous effluent resulting from c) and the part of the liquid effluent 9b resulting from c) which is not recycled to stage a); the final mixture reaches a temperature of 40° C. in an HP cold drum operating at a pressure substantially identical to that of stage c), at the outlet of which a hydrogen-rich gas fraction, an aqueous fraction and the washed liquid effluent are obtained. The hydrogen-rich gas faction is recycled upstream of the reaction section. The aqueous fraction resulting from the HP cold drum is sent to a stripping column operating at approximately 0.4 MPa abs. in order to obtain a stripped aqueous faction and a sour gas fraction. The washed liquid effluent is treated in a stabilization column operating at approximately 0.8 MPa abs., making it possible to obtain light gases and a stabilized liquid hydrocarbon effluent 13. The light gas fraction and the sour gases constitute the second gaseous effluent 11. The yields of the various fractions obtained after separation are shown in Table 6 (the yields corresponding to the ratios of the amounts by weight of the various products obtained, with respect to the weight of feedstock upstream of the stage a), expressed as percentage and denoted % w/w).

TABLE 6

| Yields of the various products obtained after separation | | |
|---|---|---|
| Gas fraction 11 ($NH_3$ + $H_2S$ + $C_1$-$C_4$) | % w/w | 0.93 |
| Liquid fraction 13 | % w/w | 99.40 |

All or part of the liquid fraction obtained can subsequently be upgraded in a steam cracking stage for the purpose of forming olefins which can be polymerized for the purpose of forming recycled plastics.

The process carried out according to the invention results in reduced catalytic deactivations during the hydrogenation stage a) and during the hydrotreating stage b), with respect to the catalytic deactivations observed according to the prior art.

The invention clamed is:

1. A process for treatment of a feedstock comprising a plastics pyrolysis oil, said process comprising:

a) a hydrogenation stage carried out in a hydrogenation reaction section, employing at least one fixed-bed reactor having n catalytic beds, n being an integer greater than or equal to 1, each comprising at least one hydrogenation catalyst, said hydrogenation reaction section being fed at least with said feedstock as a mixture with at least a part of a liquid effluent resulting from a separation stage c) and a first gas stream comprising hydrogen, said hydrogenation reaction section being employed at an average temperature between 140 and 400° C., a partial hydrogen pressure between 1.0 and 10.0 MPa abs, and an hourly space velocity between 0.1 and 10.0 $h^{-1}$, in order to obtain a hydrogenated effluent, b) a hydrotreating stage carried out in a hydrotreating reaction section, employing at least one fixed-bed reactor having n catalytic beds, n being an integer greater than or equal to 1, each comprising at least one hydrotreating catalyst, said hydrotreating reaction section being fed at least with said hydrogenated effluent resulting from stage a) and a second gas stream comprising hydrogen, said hydrotreating reaction section being employed at an average temperature between 250 and 430° C., a partial hydrogen pressure between 1.0 and 10.0 MPa abs, and an hourly space velocity between 0.1 and 10.0 $h^{31\ 1}$, in order to obtain a hydrotreated effluent, c) a separation stage, fed with the hydrotreated effluent resulting from stage b), said stage being carried out at a temperature of between 200 and 450° C. and at a pressure substantially identical to the pressure of stage b), in order to obtain at least a first gaseous effluent, and the liquid effluent, a part of which is recycled upstream of stage a), said pressure substantially identical to the pressure of stage b) being the pressure of stage b) with a pressure difference of between 0 and 1 MPa, d) a separation stage, fed with the first gaseous effluent and another part of the liquid effluent resulting from stage c) and an aqueous solution, said stage being carried out at a temperature of between 20 and less than 200° C. and at a pressure substantially identical to or less than the pressure of stage c), in order to obtain at least a second gaseous effluent, an aqueous effluent and a hydrocarbon effluent, said pressure substantially identical to the pressure of stage c) being the pressure of stage c) with a pressure difference of between 0 and 1 MPa, e) a stage of fractionation of all or part of the hydrocarbon effluent resulting from stage d), in order to obtain at least a third gaseous effluent and at least a first hydrocarbon cut comprising compounds having a boiling point of less than or equal to 175° C. and a second hydrocarbon cut comprising compounds having a boiling point of greater than 175° C., f) optionally, a hydrocracking stage carried out in a hydrocracking reaction section, employing at least one fixed-bed reactor having n catalytic beds, n being an integer greater than or equal to 1, each comprising at least one hydrocracking catalyst, said hydrocracking reaction section being fed with at least a part of said hydrocarbon effluent resulting from stage d), or with at least a part of the second hydrocarbon cut comprising compounds having a boiling point of greater than 175° C. resulting from stage e), or with a combination of at least a part of said hydrocarbon effluent resulting from stage d) and at least a part of the second hydrocarbon cut comprising compounds having a boiling point of greater than 175° C. resulting from stage e), and a third gas stream comprising hydrogen, said hydrocracking reaction section being employed at an average temperature between 250 and 450° C., a partial hydrogen pressure between 1.5 and 20.0 MPa abs. and an hourly space velocity between 0.1 and 10.0 $h^{31\ 1}$, in order to obtain a first hydrocracked effluent.

2. The process according to claim 1, further comprising the hydrocracking stage f).

3. The process according to claim 1, wherein, in stage a), the hydrogen coverage is of between 250 and 800 $Sm^3$ of hydrogen per m3 of feedstock ($Sm^3/m^3$).

4. The process according to claim 1, wherein at least a part of the liquid effluent resulting from the separation stage c) is preheated before being recycled upstream of the hydrogenation stage a).

5. The process according to claim 1, wherein the ratio by weight of the liquid effluent resulting from stage c) recycled in stage a) to the feedstock comprising a plastics pyrolysis oil is of between 0.01 and 10.

6. The process according to claim 1, further comprising a stage a0) of pretreatment of the feedstock comprising a plastics pyrolysis oil, said pretreatment stage being carried out upstream of the hydrogenation stage a), and comprising a filtration stage and/or an electrostatic separation stage and/or a stage of washing by means of an aqueous solution and/or an adsorption stage.

7. The process according to claim 1, wherein the hydrocarbon effluent resulting from the separation stage d), or at least one of the two liquid hydrocarbon cuts resulting from stage e), is sent, in all or part, to a steam cracking stage g) carried out in at least one pyrolysis furnace at a temperature of between 700 and 900° C. and at a pressure of between 0.05 and 0.3 MPa relative.

8. The process according to claim 1, wherein the reaction section of stage a) employs at least two reactors operating in permutable mode.

9. The process according to claim 1, wherein a stream containing an amine and/or a sulfur compound is injected upstream of stage a).

10. The process according to claim 1, wherein the gaseous effluent resulting from stages c), d) and/or e), and/or the liquid effluent from stage c) and/or the hydrocarbon effluent resulting from stage d) and/or the first and/or the second hydrocarbon cut resulting from stage e) is/are subjected to a stage of adsorption of heavy metals.

11. The process according to claim 1, wherein said hydrogenation catalyst comprises a support chosen from alumina, silica, silica-aluminas, magnesia, clays and their mixtures and a hydro-dehydrogenating function comprising either at least one element from group VIII and at least one element from group VIB or at least one element from group VIII.

12. The process according to claim 1, wherein said hydrotreating catalyst comprises a support chosen from the group consisting of alumina, silica, silica-aluminas, magnesia, clays and their mixtures and a hydro-dehydrogenating function comprising at least one element from group VIII and/or at least one element from group VIB.

13. The process according to claim 1, further comprising a second hydrocracking stage f') carried out in a hydrocracking reaction section, employing at least one fixed-bed reactor having n catalytic beds, n being an integer greater than or equal to 1, each comprising at least one hydrocracking catalyst, said hydrocracking reaction section being fed with at least a part of the first hydrocracked effluent resulting from the first hydrocracking stage f) and a gas stream comprising hydrogen, said hydrocracking reaction section being employed at a temperature between 250 and 450° C., a partial hydrogen pressure between 1.5 and 20.0 MPa abs. and an hourly space velocity between 0.1 and 10.0 $h^{31\ 1}$, in order to obtain a second hydrocracked effluent.

14. The process according to claim 1, wherein said hydrocracking catalyst comprises a support chosen from halogenated aluminas, combinations of boron and aluminum oxides, amorphous silica-aluminas and zeolites and a hydro-dehydrogenating function comprising at least one metal from group VIB chosen from chromium, molybdenum and tungsten, alone or as a mixture, and/or at least one metal from group VIII chosen from iron, cobalt, nickel, ruthenium, rhodium, palladium and platinum.

15. The stage process according to claim 1, wherein stage c) is performed at a temperature of between 220 and 330° C. and stage d) is performed at a temperature of between 25 and 120° C.

16. The stage process according to claim 6, wherein stage a0) is performed advantageously carried out at a temperature between 0 and 150° C., and at a pressure between 0.15 and 10.0 MPa abs.

17. The process according to claim 1, wherein, in stage b), the hydrogen coverage is between 100 and 1500 $Sm^3$ of hydrogen per $m^3$ of feedstock ($Sm^3/m^3$) which feeds stage a).

18. The process according to claim 3, wherein, in stage b), the hydrogen coverage is between 100 and 1500 $Sm^3$ of hydrogen per $m^3$ of feedstock ($Sm^3/m^3$) which feeds stage a).

19. The process according to claim 1, wherein the amount of liquid effluent recycled from stage c) to stage a) in terms of the ratio by weight of the recycle stream from stage c) to the feedstock comprising a plastics pyrolysis oil is less than or equal to 10 and greater than or equal to 0.001.

* * * * *